US008516723B2

(12) United States Patent
Ferrigan et al.

(10) Patent No.: US 8,516,723 B2
(45) Date of Patent: Aug. 27, 2013

(54) MIDFOOT INSERT CONSTRUCTION

(75) Inventors: Timothy S. Ferrigan, Banks, OR (US); Brian Foresta, Portland, OR (US); Patricia J. Graser, Hillsboro, OR (US); Christine L. Saito, Boulder, CO (US)

(73) Assignee: NIKE, Inc., Beaverton, OR (US)

( * ) Notice: Subject to any disclaimer, the term of this patent is extended or adjusted under 35 U.S.C. 154(b) by 545 days.

(21) Appl. No.: 12/713,832

(22) Filed: Feb. 26, 2010

(65) Prior Publication Data

US 2010/0293815 A1 Nov. 25, 2010

Related U.S. Application Data

(63) Continuation-in-part of application No. 12/419,671, filed on Apr. 7, 2009, now Pat. No. 8,333,024.

(60) Provisional application No. 61/103,922, filed on Oct. 8, 2008.

(51) Int. Cl.
*A43B 13/14* (2006.01)
*A43B 7/22* (2006.01)

(52) U.S. Cl.
USPC ..... 36/102; 36/59 C; 36/91; 36/32 R

(58) Field of Classification Search
USPC ..... 36/102, 59 C, 91, 32 R, 103, 146, 36/59 R; D2/953, 954, 957–960
See application file for complete search history.

(56) References Cited

U.S. PATENT DOCUMENTS

| | | | | |
|---|---|---|---|---|
| D39,747 | S | 1/1909 | McKenna | |
| 1,687,294 | A * | 10/1928 | Hopwood | 36/59 C |
| D78,502 | S * | 5/1929 | Blair | D2/954 |
| D90,057 | S * | 5/1933 | Van Cleef | D2/949 |
| D119,266 | S * | 3/1940 | Johnson | D2/959 |
| D201,952 | S | 8/1965 | Johns | |
| D234,930 | S | 4/1975 | Arambasic | |
| 4,096,649 | A | 6/1978 | Saurwein | |
| D248,897 | S * | 8/1978 | Toothaker | D2/958 |
| 4,128,951 | A | 12/1978 | Tansill | |
| 4,227,320 | A | 10/1980 | Borgeas | |
| D259,595 | S | 6/1981 | Famolare, Jr. | |
| 4,366,634 | A | 1/1983 | Giese et al. | |
| D275,146 | S | 8/1984 | Kilgore | |
| 4,494,320 | A | 1/1985 | Davis | |
| 4,519,148 | A | 5/1985 | Sisco | |
| 4,541,186 | A | 9/1985 | Mulvihill | |
| 4,562,651 | A | 1/1986 | Frederick et al. | |
| 4,571,852 | A | 2/1986 | Lamarche et al. | |
| 4,653,206 | A | 3/1987 | Tanel | |

(Continued)

FOREIGN PATENT DOCUMENTS

| | | |
|---|---|---|
| GB | 2 221 140 | 1/1990 |
| GB | 2 425 931 | 11/2006 |
| WO | 94/04049 | 3/1994 |

*Primary Examiner* — Ted Kavanaugh

(74) *Attorney, Agent, or Firm* — Plumsea Law Group, LLC

(57) ABSTRACT

An article of footwear is provided and includes an outsole structure having a forefoot portion, a heel portion, and a midfoot portion disposed between the forefoot portion and the heel portion. The midfoot portion includes a series of ribs cooperating to define a series of pockets disposed between the forefoot portion and the heel portion. The plurality of pockets include a smaller volume proximate to a longitudinal axis extending through a center of the outsole structure and a greater volume proximate to an outboard, lateral edge and an outboard, medial edge of the article of footwear.

23 Claims, 19 Drawing Sheets

(56) References Cited

U.S. PATENT DOCUMENTS

| | | | | |
|---|---|---|---|---|
| 4,676,011 | A | | 6/1987 | O'Rourke et al. |
| D295,462 | S | | 5/1988 | Brown et al. |
| D305,279 | S | * | 1/1990 | Hase ..... D2/953 |
| 4,890,398 | A | | 1/1990 | Thomasson |
| 4,897,936 | A | | 2/1990 | Fuerst |
| 5,012,597 | A | | 5/1991 | Thomasson |
| 5,111,597 | A | | 5/1992 | Hansen et al. |
| 5,203,097 | A | | 4/1993 | Blair |
| 5,282,288 | A | | 2/1994 | Henson |
| 5,313,718 | A | | 5/1994 | McMahon et al. |
| 5,392,537 | A | | 2/1995 | Goldberg |
| 5,410,821 | A | | 5/1995 | Hilgendorf |
| D366,952 | S | | 2/1996 | Pyle |
| D373,674 | S | | 9/1996 | Dolinsky |
| 5,560,126 | A | | 10/1996 | Meschan et al. |
| 5,669,161 | A | | 9/1997 | Huang |
| 5,682,685 | A | | 11/1997 | Terlizzi |
| D387,864 | S | | 12/1997 | Hatfield |
| 5,740,618 | A | | 4/1998 | Minden |
| D394,939 | S | | 6/1998 | Avar |
| 5,761,832 | A | | 6/1998 | George |
| D397,851 | S | | 9/1998 | Greenberg |
| D400,344 | S | | 11/1998 | Avar |
| 5,918,385 | A | | 7/1999 | Sessa |
| D413,012 | S | | 8/1999 | Challant |
| D415,339 | S | | 10/1999 | Rombis |
| 5,970,631 | A | | 10/1999 | Inman |
| 6,023,859 | A | | 2/2000 | Burke et al. |
| 6,035,559 | A | | 3/2000 | Freed et al. |
| 6,076,283 | A | | 6/2000 | Boie |
| 6,161,240 | A | | 12/2000 | Huang |
| 6,266,897 | B1 | | 7/2001 | Seydel et al. |
| 6,308,439 | B1 | | 10/2001 | Ellis, III |
| 6,389,712 | B1 | | 5/2002 | Schelling |
| D460,247 | S | | 7/2002 | Liu et al. |
| 6,412,196 | B1 | | 7/2002 | Gross |
| 6,470,600 | B1 | | 10/2002 | Louie |
| 6,516,540 | B2 | | 2/2003 | Seydel et al. |
| 6,516,541 | B2 | | 2/2003 | Cagner |
| D476,143 | S | | 6/2003 | McDowell |
| 6,574,889 | B2 | | 6/2003 | Cagner |
| 6,578,290 | B1 | | 6/2003 | Meynard |
| 6,609,312 | B1 | | 8/2003 | Ellis, III |
| D480,202 | S | | 10/2003 | Schroeder et al. |
| 6,634,121 | B2 | | 10/2003 | Sordi |
| D489,880 | S | | 5/2004 | McClaskie |
| 6,748,674 | B2 | | 6/2004 | Ellis, III |
| D493,027 | S | | 7/2004 | Heil |
| 6,789,332 | B1 | | 9/2004 | Scholz |
| 6,865,825 | B2 | | 3/2005 | Bailey, Sr. et al. |
| 6,883,253 | B2 | | 4/2005 | Smith et al. |
| D504,555 | S | | 5/2005 | Urie |
| D504,998 | S | | 5/2005 | McClaskie |
| 6,895,693 | B2 | | 5/2005 | Baruck |
| 6,931,768 | B2 | | 8/2005 | Baek |
| D512,212 | S | | 12/2005 | Hatfield |
| D512,826 | S | | 12/2005 | Hatfield |
| 7,020,988 | B1 | | 4/2006 | Holden et al. |
| 7,168,190 | B1 | | 1/2007 | Gillespie |
| 7,191,550 | B2 | | 3/2007 | Baek |
| D540,013 | S | | 4/2007 | Issler |
| D540,015 | S | | 4/2007 | McClaskie |
| 7,225,564 | B1 | | 6/2007 | Gillespie |
| D551,833 | S | | 10/2007 | Feller |
| 7,278,226 | B2 | | 10/2007 | Holden et al. |
| D555,887 | S | | 11/2007 | Link |
| D560,336 | S | * | 1/2008 | Nakashima ..... D2/959 |
| 7,334,354 | B2 | | 2/2008 | Foxen et al. |
| D564,735 | S | | 3/2008 | McClaskie |
| D569,593 | S | | 5/2008 | Avar |
| 7,377,055 | B2 | | 5/2008 | Bramani |
| D573,333 | S | | 7/2008 | Petrie |
| D573,334 | S | | 7/2008 | Petrie |
| 7,392,604 | B2 | | 7/2008 | Greene et al. |
| D577,883 | S | * | 10/2008 | Link ..... D2/959 |
| D586,994 | S | * | 2/2009 | Chang ..... D2/959 |
| 2002/0043008 | A1 | | 4/2002 | Favreau |
| 2002/0078591 | A1 | | 6/2002 | Morrone |
| 2002/0166262 | A1 | | 11/2002 | Hernandez |
| 2003/0056394 | A1 | | 3/2003 | Yu |
| 2003/0201563 | A1 | | 10/2003 | Umezawa |
| 2005/0183286 | A1 | | 8/2005 | Crary |
| 2005/0229431 | A1 | | 10/2005 | Gerlin |
| 2006/0010718 | A1 | | 1/2006 | Auger et al. |
| 2006/0143944 | A1 | | 7/2006 | Collins |
| 2006/0156581 | A1 | | 7/2006 | Holden et al. |
| 2006/0288611 | A1 | | 12/2006 | Hogan |
| 2007/0107264 | A1 | | 5/2007 | Meschter et al. |
| 2007/0107265 | A1 | | 5/2007 | Mueller et al. |
| 2007/0199208 | A1 | | 8/2007 | Wilkenfeld |
| 2007/0227039 | A1 | | 10/2007 | Chaney et al. |
| 2007/0227045 | A1 | | 10/2007 | Aveni et al. |
| 2007/0277394 | A1 | | 12/2007 | Hansen et al. |
| 2008/0000108 | A1 | | 1/2008 | Ellis, III |
| 2008/0010854 | A1 | | 1/2008 | Sokolowski |
| 2008/0034613 | A1 | | 2/2008 | Wilkenfeld et al. |
| 2008/0141562 | A1 | | 6/2008 | Peveto |
| 2008/0168681 | A1 | | 7/2008 | Andersen et al. |

* cited by examiner

MIDFOOT INSERT CONSTRUCTION

CROSS-REFERENCE TO RELATED APPLICATION

This application is a continuation-in-part of U.S. patent application Ser. No. 12/419,671 filed on Apr. 7, 2009, which claims the benefit of U.S. Provisional Patent Application No. 61/103,922 filed on Oct. 8, 2008. The entire disclosures of each of the above applications are incorporated herein by reference.

FIELD

The present disclosure relates to an article of footwear, and in particular, to an article of footwear incorporating flex grooves and/or a midfoot insert providing the article of footwear with increased flexibility.

BACKGROUND

This section provides background information related to the present disclosure which is not necessarily prior art.

Articles of footwear configured for pivoting have been previously proposed. These articles typically include a pivot disposed on a ball portion of a foot. In addition, the periphery of a sole surrounding the pivot does not contact the ground in a uniform manner, which can lead to instability of the foot.

There is a need in the art for a design that overcomes these shortcomings.

Conventional footwear typically includes an upper structure and a sole structure that cooperate to support a foot during use. The upper structure securely receives and positions the foot while the sole structure, which is typically secured to a lower portion of the upper structure and generally between the foot and a ground surface, provides traction, support, and cushioning for the user.

Modern articles of footwear also provide a user with enhanced style and athletic performance and may be specifically designed for use during a particular activity or sport. For example, articles of footwear designed specifically for a particular sport such as baseball, football, or soccer, typically include a relatively rigid outsole and a series of cleats extending therefrom. The rigid outsole, while limiting flexibility, prevents undulations in and/or debris disposed on a playing surface from causing injury to a user's foot by preventing such undulations and/or debris from applying a force through the outsole to the user's foot. Such rigid outsoles may even enhance the ability of the user in making sharp cuts during running and may further support the user's foot by restricting rotation of the foot relative to the outsole.

While a relatively rigid outsole provides a benefit to a user during a particular sport such as baseball, football, or soccer, such a rigid outsole is not suitable for every sport. In running, for example, an article of footwear must concurrently provide the user with a relatively flexible outsole to accommodate motion of the user's foot during use, as well as provide adequate support to the user's foot to absorb impact forces associated with foot strike. An article of footwear intended for running, therefore, typically strikes a balance between support and flexibility.

As described above, articles of footwear may be designed to have an outsole suited for the particular application of the article of footwear. While articles of footwear intended for baseball, football, and soccer may include a relatively rigid outsole and articles of footwear intended for running may include a combination of support and flexibility, neither article of footwear is particularly suitable for use in a sport or activity that requires pivoting and/or torsional movement of a user's foot about a longitudinal axis of the foot. For example, while articles of footwear designed for running provide a user with a degree of flexibility, the flexibility provided typically allows the ball of the foot to rotate about an axis extending substantially perpendicular to a longitudinal axis of the user's foot to allow the foot to bend and flex during running and jogging. While such flexibility may provide some degree of flexibility about a longitudinal axis of the user's foot, such rotation is typically prevented or restricted to limit the amount of roll experienced by a user's foot during running to provide the foot with proper support.

Dancing and aerobics are two activities that require flexation and/or torsional movement of a user's foot about a longitudinal axis of the user's foot. During such activities, a user is required to perform many activities and to perform such activities in rapid succession. For example, a dancer is often required to move from a pivot motion on a ball of the dancer's foot to a lateral motion, transferring weight between the user's feet to perform a particular dance move or step. Likewise, during aerobics, a user often rapidly changes direction—often shifting weight between the user's feet in an effort to perform a particular exercise. In either of the foregoing activities, such movement is accomplished by permitting the user's foot to flex about a longitudinal axis of the user's foot.

Conventional articles of footwear do not typically permit a user's foot to flex about a longitudinal axis of the foot, as described above. Providing an article of footwear with a degree of flexibility about a longitudinal axis of the foot enhances the ability of the article of footwear in allowing a user to rapidly move between various motions, which are typical of dance and/or aerobic activities. As such, an article of footwear that provides adequate support to a user's foot while concurrently permitting the user's foot to flex about a longitudinal axis of the user's foot enhances the ability of the user to perform dance and/or aerobic movements.

In addition to providing a user with the ability to perform enhanced dance and/or aerobic movements, users participating in such activities are particularly concerned with the overall aesthetic appearance of the article of footwear. In many cases, it is desirable that the article of footwear match or be an extension of a costume or outfit specifically designed for a particular dance or aerobic routine. To that end, an article of footwear accommodating the above characteristics with respect to flexation and support that concurrently provides the user with the ability to customize the aesthetic appearance of the article of footwear enhances the overall utility of the article of footwear and, thus, the enjoyment of the user when purchasing and using the article of footwear.

SUMMARY

This section provides a general summary of the disclosure, and is not a comprehensive disclosure of its full scope or all of its features.

The invention discloses an article of footwear for dancing. In one aspect, the invention provides an article of footwear, comprising: a sole including a central portion and a peripheral portion disposed outwards from the central portion; a pivot portion disposed on the central portion; a plurality of flex grooves extending in a radial direction from the pivot portion, at least one flex groove of the plurality of flex grooves extending through the central portion and the peripheral portion; and where the plurality of flex grooves is configured to facilitate bending of the central portion and the peripheral portion.

In another aspect, the plurality of flex grooves includes a first flex groove set including four flex grooves that are arranged in a cross-hair like pattern around the pivot portion.

In another aspect, a longitudinal flex groove of the first flex groove set extends from the pivot portion to a heel portion of the sole.

In another aspect, the longitudinal flex groove extends over a substantial majority of the length of the sole and wherein the location of the longitudinal flex groove corresponds to a centerline of the sole.

In another aspect, the plurality of flex grooves includes a second flex groove set including four flex grooves associated with the peripheral portion of the sole and wherein each of the flex grooves from the second flex groove set is disposed between two adjacent flex grooves from the first flex groove set.

In another aspect, the sole includes a plurality of sole pods and wherein the plurality of sole pods are disposed on the peripheral portion of the sole.

In another aspect, the plurality of sole pods includes a first sole pod, a second sole pod and a third sole pod, disposed on a toe portion, lateral portion and a medial portion of the peripheral portion, respectively.

In another aspect, the first sole pod and the third sole pod are separated by a second flex groove of the first flex groove set and wherein the second sole pod and the third sole pod are separated by a third flex groove of the second flex groove set.

In another aspect, the pivot portion has a first coefficient of friction that is substantially less than a second coefficient of friction of the plurality of sole pods.

In another aspect, the invention provides an article of footwear, comprising: a sole including a central portion and a peripheral portion disposed outwards from the central portion; a pivot portion disposed on the central portion; a plurality of sole pods disposed on the peripheral portion, the plurality of sole pods partially surrounding the pivot portion; the pivot portion having a first coefficient of friction and the plurality of sole pods having a second coefficient of friction; and where the first coefficient of friction is substantially less than the second coefficient of friction.

In another aspect, the plurality of sole pods includes at least three sole pods including a first sole pod, a second sole pod and a third sole pod disposed on a lateral portion, medial portion and toe portion of the peripheral portion, respectively.

In another aspect, the plurality of sole pods provide substantially continuous traction on the peripheral portion in a forefoot portion of the sole.

In another aspect, the plurality of sole pods includes a heel sole pod disposed on the peripheral portion in a heel portion of the sole and wherein the heel sole pod provides substantially continuous traction on the peripheral portion in the heel portion.

In another aspect, the sole includes a plurality of flex grooves configured to facilitate flexibility of the sole and wherein the plurality of flex grooves extends in a substantially radial direction from the pivot portion.

In another aspect, at least one of the flex grooves of the plurality of flex grooves extends through at least one sole pod of the plurality of sole pods.

In another aspect, at least two adjacent sole pods of the plurality of sole pods are separated by at least one flex groove from the plurality of flex grooves.

In another aspect, the invention provides an article of footwear, comprising: a sole including a forefoot portion, a heel portion and an arch portion disposed between the forefoot portion and the heel portion; a first flex groove set associated with the forefoot portion; a second flex groove set associated with the arch portion; and where first flex groove set is associated with a first average depth that is substantially less than a second average depth of the second flex groove set.

In another aspect, the first flex groove set includes a plurality of flex grooves extending in a substantially radial direction from a pivot portion of the forefoot portion.

In another aspect, the second flex groove set is configured to facilitate bending in a first bending direction associated with an upward bending of a toe portion of the sole and wherein the second flex groove set is configured to substantially reduce bending in a second bending direction associated with a downward bending of the toe portion.

In another aspect, the second flex groove set comprises four flex grooves and wherein the four flex grooves are arranged in a substantially x-like pattern.

In another aspect, an article of footwear is provided and includes an outsole structure having a forefoot portion, a heel portion, and a midfoot portion disposed between the forefoot portion and the heel portion. The midfoot portion includes a series of ribs cooperating to define a series of pockets disposed between the forefoot portion and the heel portion. The plurality of pockets include a smaller volume proximate to a longitudinal axis extending through a center of the outsole structure and a greater volume proximate to an outboard, lateral edge and an outboard, medial edge of the article of footwear.

In another aspect, a sole structure for an article of footwear is provided and includes a forefoot portion and a heel portion. A midfoot portion is disposed between the forefoot portion and the heel portion and includes a first rib having a pair of first ends respectively disposed proximate to medial and lateral outboard edges of the midfoot portion and a second rib having second ends respectively disposed proximate to medial and lateral outboard edges of the midfoot portion. The first rib cooperates with the second rib to define a first pocket disposed proximate to a center portion of the sole structure and a pair of second pockets disposed proximate to the medial and lateral outboard edges, respectively, whereby the first pocket includes a smaller volume than each of the second pockets.

Other systems, methods, features and advantages of the invention will be, or will become apparent to one with skill in the art upon examination of the following figures and detailed description. It is intended that all such additional systems, methods, features and advantages included within this description, be within the scope of the invention, and be protected by the following claims.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings. Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

Figure 1:
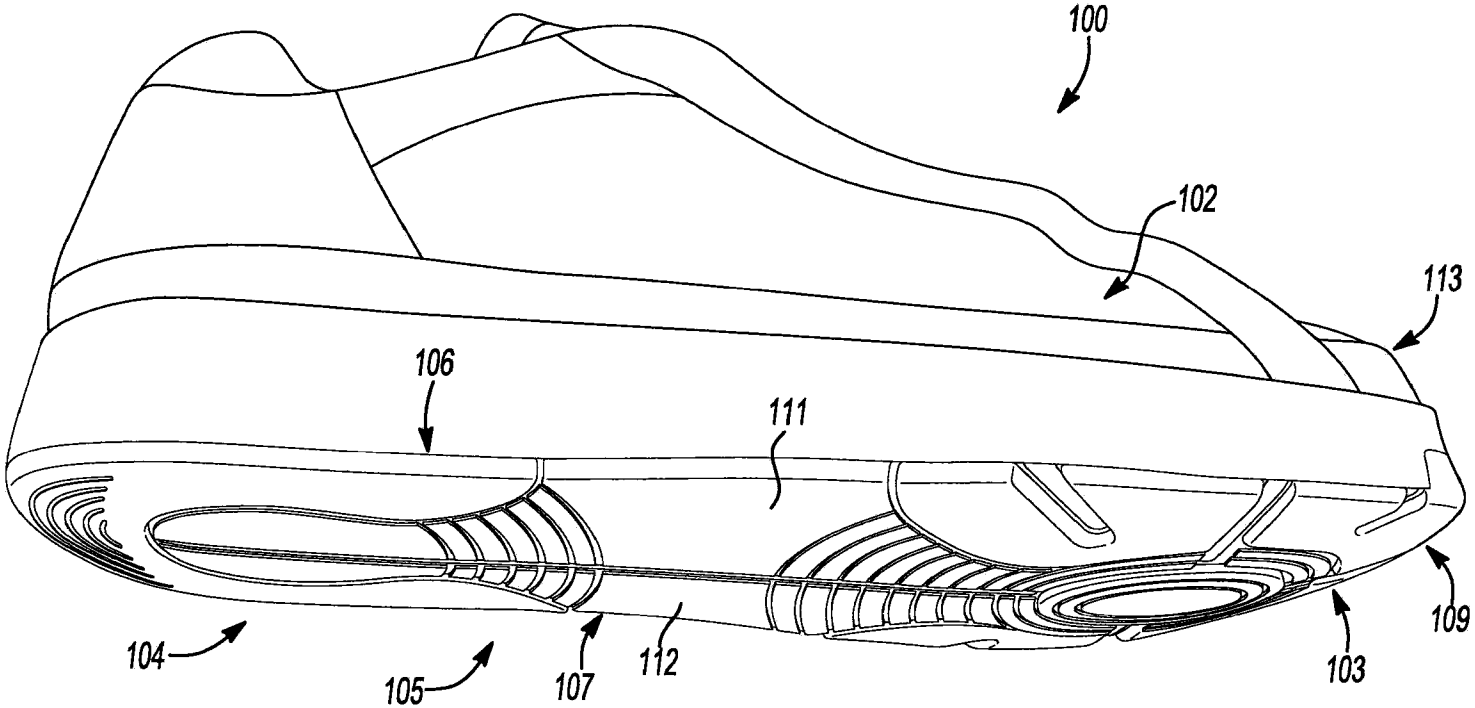
FIG. 1 is an isometric view of an embodiment of an article of footwear.
Figure 2:
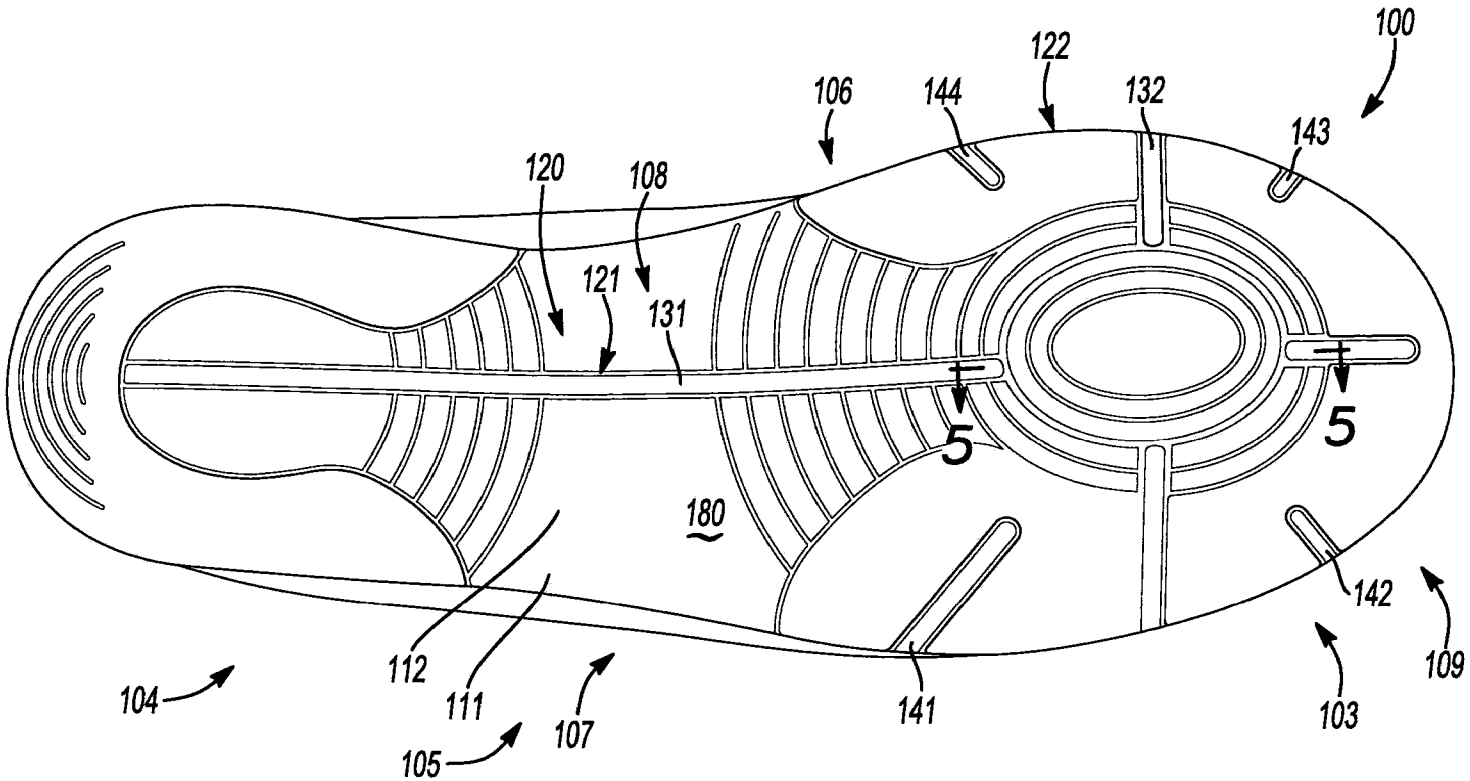
FIG. 2 is a bottom view of an embodiment of an article of footwear.

FIGS. 1 and 2 illustrate an embodiment of article of footwear 100. In particular, FIG. 1 is an isometric view of an embodiment of article of footwear 100 and FIG. 2 is a bottom view of an embodiment of article of footwear 100. For clarity, the following detailed description discusses an embodiment of article of footwear 100, in the form of a dance shoe, but it should be noted that the present invention could take the form of any article of footwear including, but not limited to: sneakers, soccer shoes, football shoes, rugby shoes, baseball shoes as well as other kinds of shoes. In some cases, article of footwear 100 may be used for hip-hop style dancing. However, in other cases, article of footwear 100 may be associated with other dancing styles.

As shown in FIGS. 1 and 2, article of footwear 100, also referred to simply as article 100, is intended to be used with a left foot. However, it should be understood that the following discussion may equally apply to a mirror image of article of footwear 100 that is intended for use with a right foot.

Article of footwear 100 includes upper 102. Generally, upper 102 may be any type of upper configured to receive a foot of a wearer. In particular, upper 102 could have any design, shape, size and/or color. For example, in embodiments where upper 102 is associated with a dance shoe configured for ballet dancing, upper 102 could be a soft bootie that is configured to enable flexing and movement of a foot. In other embodiments, however, upper 102 may comprise a stiffer structure to support a foot.

In some embodiments, article of footwear 100 may include a fastening system configured to tighten upper 102. Generally, article of footwear 100 could be associated with any type of fastening system including, but not limited to: laces, straps, zippers, hook and loop fasteners, as well as other types of fastening systems. For example, in one embodiment, article of footwear 100 may include a lacing system to tighten upper 102 around a foot.

For purposes of clarity, only some portions of upper 102 are discussed in this detailed description. However, it should be understood that upper 102 may include various features known in the art. For example, in embodiments where article 100 is a dance shoe, toe portion 113 of upper 102 may be configured with provisions for allowing a wearer to rise on toe portion 113 in an en pointe position. For example, in some cases, toe portion 113 maybe associated with provisions including, but not limited to: pads, a toe bumper and other provisions.

Article of footwear 100 can include sole 105. Generally, sole 105 can include multiple components, including, but not limited to: an outsole, a midsole and an insole. In one embodiment, sole 105 includes an outsole, a midsole and an insole, not visible for illustrative purposes.

In addition, sole 105 includes bottom surface 180. Bottom surface 180 is configured to contact a ground surface. In some embodiments, bottom surface 180 may comprise an uneven surface. In an exemplary embodiment, bottom surface 180 may comprise a substantially flat surface of sole 105.

Sole 105 further comprises forefoot portion 103 and heel portion 104. Forefoot portion 103 may be associated with a forefoot of a foot. Furthermore, forefoot portion 103 can also comprise toe portion 109 that can be associated with toes of a foot. In addition, sole 105 also includes heel portion 104. Heel portion 104 may be associated with a heel of a foot. Likewise, sole 105 includes arch portion 108 disposed between forefoot portion 103 and heel portion 104. Arch portion 108 may be associated with an arch of a foot.

Sole 105 also includes central portion 112. Central portion 112 may be associated with a central portion of a foot. Furthermore, sole 105 includes peripheral portion 111. Peripheral portion 111 is disposed outwards from central portion 112. In particular, peripheral portion 111 extends around a periphery of bottom surface 180 of sole 105. Sole 105 also includes medial portion 106. Medial portion 106 may be associated with an inside of a foot. In addition, sole 105 includes lateral portion 107, disposed opposite of medial portion 106.

A sole of an article of footwear can include provisions for increasing the flexibility in different portions of the sole, including a forefoot portion. By increasing the flexibility in different portions of the sole, portions of the sole can flex and/or bend with respect to each other. In some embodiments, a sole can include provisions for providing a high degree of flexibility on a particular portion of a sole. In some cases, for example, a sole can include provisions for increasing flexibility of a forefoot portion in multiple directions relative to an arch portion or a heel portion.

In different embodiments, increased flexibility in a portion of a sole can be achieved in different ways. In some embodiments, a sole can comprise a flexible material to allow different portions of the sole to flex and/or bend with respect to each other. In an exemplary embodiment, a sole can include a plurality of flex grooves that allow different portions of the sole to flex and/or bend with respect to one another.

Flex grooves may be formed in any manner known in the art. In some embodiments, flex grooves may be formed by removing at least a portion of a sole. In some cases, flex grooves may be filled with a more flexible material than a sole. In other cases, flex grooves may remain hollow. This arrangement can allow flex grooves to compress when a wearer flexes and/or bends a sole. With this arrangement, flex grooves can facilitate the flexing and/or bending of a sole. By disposing flex grooves in different portions of a sole, portions of a sole can flex and/or bend with respect to one another.

In different embodiments, a plurality of flex grooves may be arranged in any manner on portions of sole 105 to facilitate the flexibility of sole 105. In some embodiments, a plurality of flex grooves may extend in a longitudinal direction on a sole. The term "longitudinal direction" as used throughout this detailed description and in the claims refers to a direction running between a toe portion and a heel portion of a sole. In other embodiments, a plurality of flex grooves can extend in a lateral direction on a sole. The term "lateral direction" as used throughout this detailed description and in the claims refers to a direction that is perpendicular to the longitudinal direction. In other words, the lateral direction may run between sides of a sole. In still other embodiments, a plurality of flex grooves can extend in a radial direction from a central portion of a sole. In some cases, at least one flex groove of the plurality of flex grooves can extend through the central portion and a peripheral portion of the sole.

Figure 3:
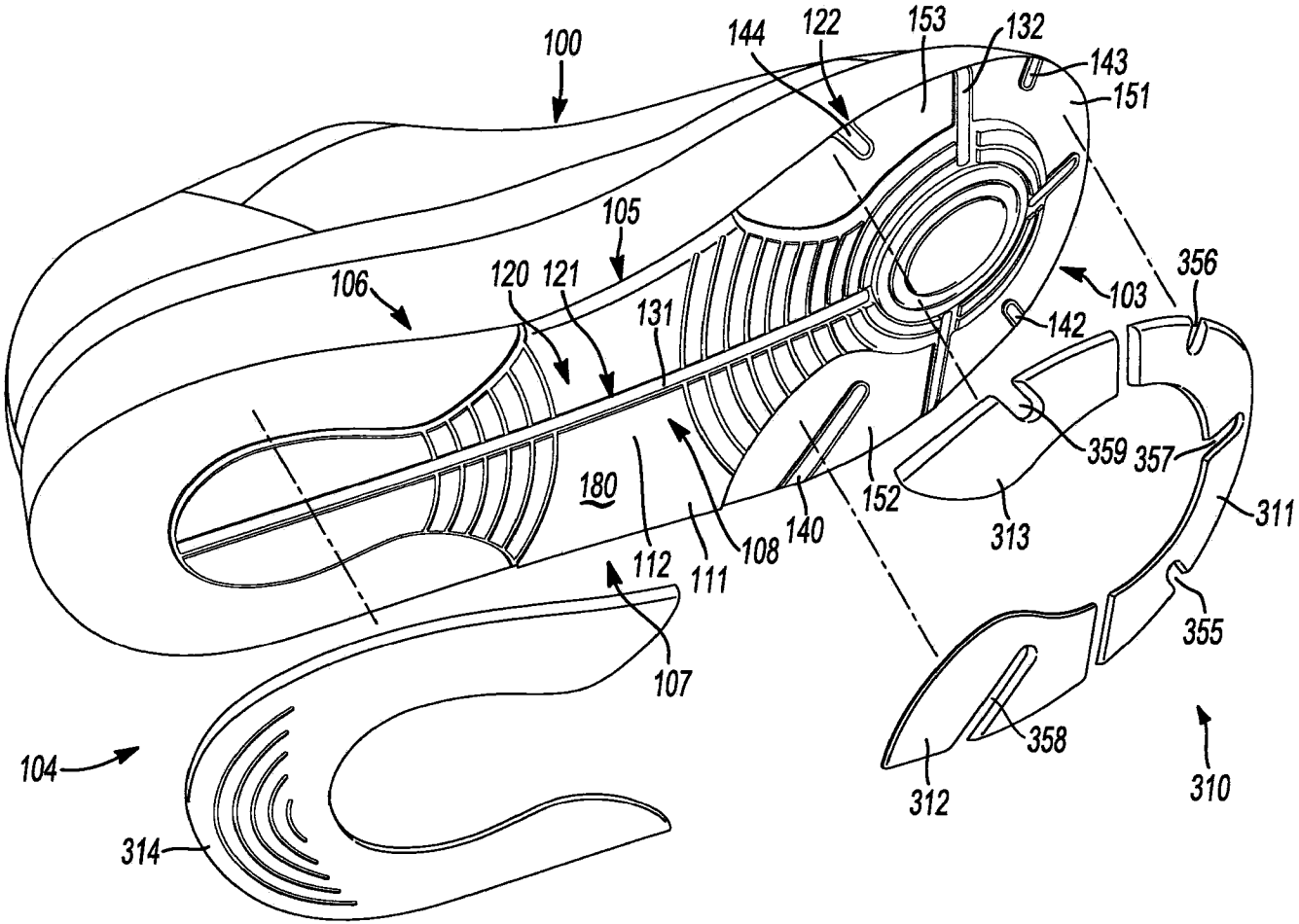
FIG. 3 is a exploded isometric view of an embodiment of an article of footwear.

FIG. 3 illustrates an isometric exploded view of an exemplary embodiment of sole 105 of article 100. Referring to FIGS. 2 and 3, sole 105 includes plurality of flex grooves 120. Plurality of flex grooves 120 includes first flex groove set 121. Furthermore, first flex groove set 121 includes longitudinal flex groove 131. Longitudinal flex groove 131 may correspond to a centerline of sole 105. In some embodiments, longitudinal flex groove 131 extends from toe portion 109 to heel portion 104. In some cases, longitudinal flex groove 131 may continuously extend from toe portion 109 to heel portion 104. In other cases, longitudinal flex groove 131 may be discontinuous as longitudinal flex groove 131 extends from toe portion 109 to heel portion 104. For example, longitudinal flex groove 131 may include a first portion that extends between central portion 112 of forefoot portion 103 to toe portion 109. Likewise, longitudinal flex groove 131 may include a second portion that extends from central portion 112 of forefoot portion 103 to heel portion 104. In other embodiments, longitudinal flex groove 131 extends from central portion 112 of forefoot portion 103 to heel portion 104. In one embodiment, longitudinal flex groove 131 extends over a substantial majority of the length of sole 105.

First flex groove set 121 may also include lateral flex groove 132. In some embodiments, lateral flex groove 132 extends in a substantially lateral direction across forefoot portion 103 of sole 105. In other words, lateral flex groove 132 extends between lateral portion 107 and medial portion 106 of forefoot portion 103. However, in other embodiments, lateral flex groove 132 may extend across another portion of sole 105, including, but not limited to: arch portion 108 or heel portion 104. In some cases, lateral flex groove 132 may continuously extend between lateral portion 107 and medial portion 106. In other cases, lateral flex groove 132 may be discontinuous as lateral flex groove 132 extends between lateral portion 107 and medial portion 106. For example, lateral flex groove 132 may include a first portion that extends from central portion 112 to lateral portion 107. Also, lateral flex groove 132 can include a second portion that extends between central portion 112 to medial portion 106. With this arrangement, lateral flex groove 132 extends through central portion 112 and peripheral portion 111.

In one embodiment, first flex groove set 121 may be arranged in a cross-hair like pattern on sole 105. In some cases, the cross-hair like pattern formed by first flex groove set 121 may be disposed on central portion 112 of forefoot portion 103. With this arrangement, longitudinal flex groove 131 and lateral flex groove 132 of first flex groove set 121 may extend in a radial direction from central portion 112 of forefoot portion 103.

In embodiments that include longitudinal flex groove 131 and lateral flex groove 132, forefoot portion 103 can also comprise first portion 151, second portion 152 and third portion 153. In particular, first portion 151 may be separated from second portion 152 and third portion 153 by lateral flex groove 132. Furthermore, second portion 152 and third portion 153 may be separated from each other by longitudinal flex groove 131. In some cases, first portion 151 may be associated with toe portion 109 of sole 105. In a similar manner, second portion 152 may be associated with lateral portion 107 of forefoot portion 103. Likewise, third portion 153 can be associated with medial portion 106 of forefoot portion 103. With this configuration, longitudinal flex groove 131 and lateral flex groove 132 may facilitate the bending and/or flexing of first portion 151, second portion 152 and third portion 153 with respect to each other.

In some embodiments, plurality of flex grooves 120 also includes second flex groove set 122. In some cases, second flex groove set 122 may be associated with peripheral portion 111 of forefoot portion 103. Furthermore, second flex groove set 122 extends in a diagonal direction that is between a lateral direction and a longitudinal direction. With this configuration, second flex groove set 122 extends in a radial direction from central portion 112 within forefoot portion 103.

Generally, second flex groove set 122 can include any number of flex grooves. In one embodiment, second flex groove set 122 includes four flex grooves. In particular, second flex groove set 122 includes first flex groove 141, second flex groove 142, third flex groove 143 and fourth flex groove 144.

In the current embodiment, first flex groove 141 is disposed within second portion 152 of forefoot portion 103. In a similar manner, second flex groove 142 and third flex groove 143 are disposed within first portion 151 of forefoot portion 103. Likewise, fourth flex groove 144 is disposed within third portion 153 of forefoot portion 103. This arrangement of flex grooves of second flex groove set 122 enhances the flexing and/or bending of different portions of forefoot portion 103 with respect to one another. Furthermore, each of the flex grooves of second flex groove set 122 is disposed between two adjacent flex grooves of first flex groove set 121. With this arrangement, flex grooves of both first flex groove set 121 and second flex groove set 122 can facilitate the bending of central portion 112 and peripheral portion 111 to assist with various dance moves. In particular, using flex grooves provides a high degree of multidirectional flexibility in the forefoot portion of the sole. In some cases, this arrangement allows a forefoot portion to flex in substantially any direction. Furthermore, this arrangement may allow for increased flexibility of the forefoot portion over the arch portion and the heel portion of the sole.

A sole of an article of footwear can include provisions to increase traction with a ground surface. Examples of ground surfaces include, but are not limited to: natural or synthetic grass, residential or commercial flooring, concrete, asphalt, as well as other types of surfaces. Generally, any portion of a sole can include provisions to increase traction. For example, in some embodiments, a central portion of a sole may include provisions to increase traction with a ground surface. In other embodiments, a central portion and a peripheral portion of a sole may include provisions to increase traction with a ground surface. In still other embodiments, a peripheral portion of a sole may include provisions to increase traction with a ground surface.

In some cases, a sole may include traction elements and/or cleats to increase traction. In other cases, a sole may include a textured surface to increase traction. In still other cases, a sole may include sole pods to increase traction with a ground surface.

Figure 4:
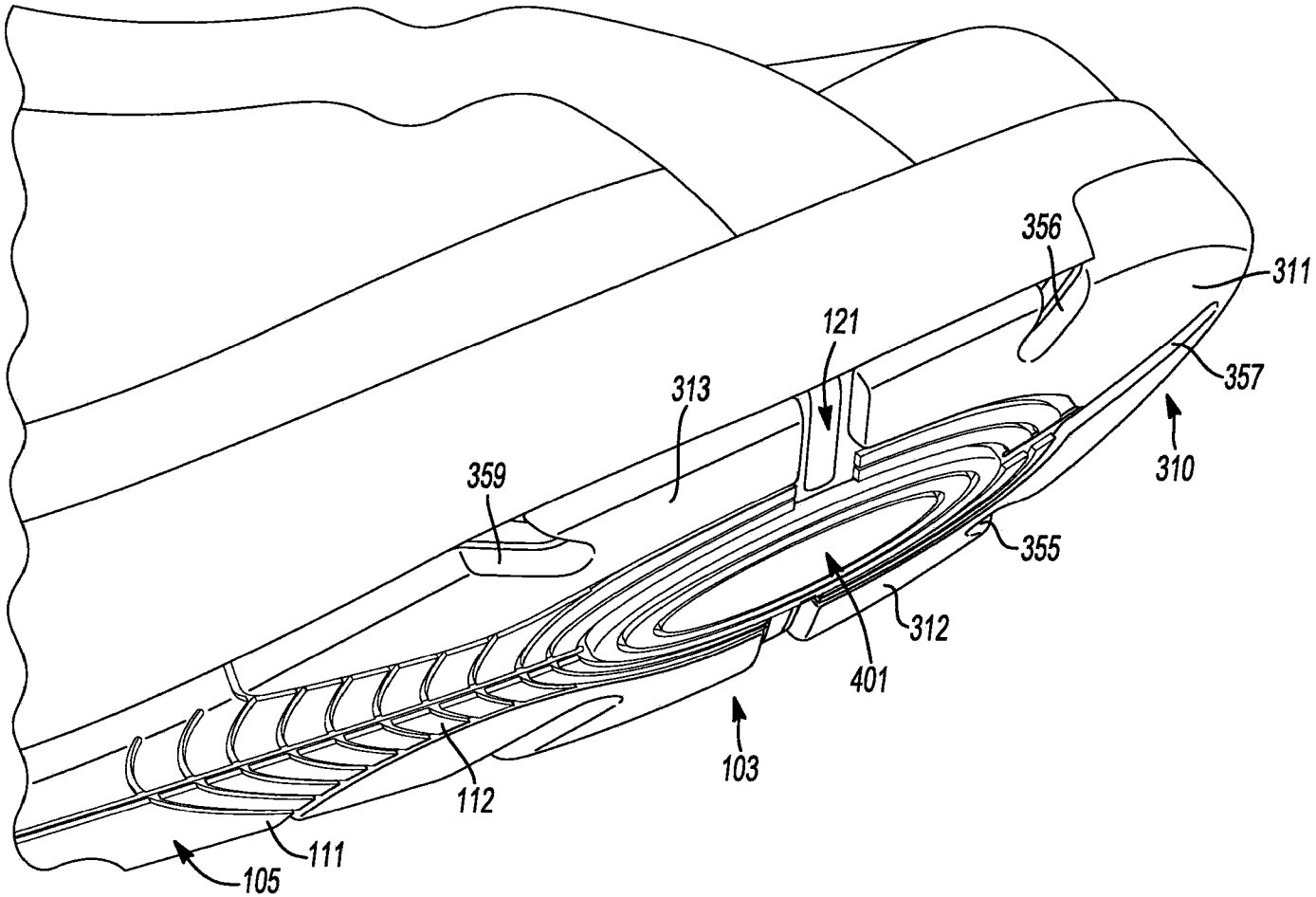
FIG. 4 is an isometric bottom view of an embodiment of a forefoot portion of an article of footwear.

Referring to FIGS. 3 and 4, sole 105 includes plurality of sole pods 310. Generally, plurality of sole pods 310 can be disposed in various locations on sole 105 to provide substantially continuous traction with a ground surface. In some embodiments, plurality of sole pods 310 may be disposed on central portion 112 of sole 105. In other embodiments, plurality of sole pods 310 can be disposed on peripheral portion 111 and central portion 112 of sole 105. In still other embodiments, plurality of sole pods 310 is disposed on peripheral portion 111 of sole 105. In one embodiment, plurality of sole pods 310 can be disposed on peripheral portion 111 of forefoot portion 103. Furthermore, plurality of sole pods 310 may comprise a high friction material. Further details of this arrangement are discussed in greater detail later in this detailed description. With this configuration, plurality of sole pods 310 can provide substantially continuous traction on peripheral portion 111 of forefoot portion 103. In particular, traction for a sole can be achieved without the use of cleats or tread elements in order to maintain a substantially flat bottom surface for the sole.

In different embodiments, plurality of sole pods 310 can include various numbers of sole pods. In an exemplary embodiment, plurality of sole pods 310 includes three sole pods disposed on forefoot portion 103. In particular, plurality of sole pods 310 includes first sole pod 311, second sole pod 312 and third sole pod 313.

In one embodiment, plurality of sole pods 310 can be disposed on forefoot portion 103 in a manner that corresponds with portions of forefoot portion 103 associated with first flex groove set 121. In particular, first sole pod 311 may correspond with first portion 151 of forefoot portion 103. Likewise, second sole pod 312 can correspond with second portion 152. In a similar manner, third sole pod 313 may correspond with third portion 153. With this arrangement, first sole pod 311, second sole pod 312 and third sole pod 313 may not interfere with the increased bending and flexing provided by first flex groove set 121.

In embodiments where sole pods are disposed above flex grooves, sole pods can include provisions to accommodate the bending and flexing of the underlying flex grooves. In some cases, sole pods can include flex grooves to accommodate bending and flexing at the underlying flex grooves. For example, referring to FIG. 3, first sole pod 311, second sole pod 312 and third sole pod 313 are configured with flex grooves that are aligned with the underlying flex grooves of first flex groove set 121 and second flex groove set 122.

In one embodiment, first sole pod 311 includes fifth flex groove 355 that corresponds with second flex groove 142 of second flex groove set 122. In addition, first sole pod 311 is configured with sixth flex groove 356 that corresponds with third flex groove 143 of second flex groove set 122. Furthermore, first sole pod 311 includes seventh flex groove 357 that is aligned with the underlying portion of longitudinal flex groove 131 of first flex groove set 121. In a similar manner, second sole pod 312 includes eighth flex groove 358 that is aligned with underlying first flex groove 141. Likewise, third sole pod 313 includes ninth flex groove 359 that is aligned with underlying fourth flex groove 144. With this configuration, plurality of sole pods 310 can accommodate the increased bending and flexing provided by first flex groove set 121 and second flex groove set 122.

In some embodiments, first portion 151, second portion 152 and third portion 153 may be configured with recesses to receive plurality of sole pods 310. However, in other embodiments, first portion 151, second portion 152 and third portion 153 may not include recesses to receive plurality of sole pods 310. In some cases, this may allow plurality of sole pods 310 to extend above bottom surface 180 of sole 105. In embodiments where recesses in portions of forefoot portion 103 receive plurality of sole pods 310, plurality of sole pods 310 may be generally flush with bottom surface 180 of sole 105.

In different embodiments, sole pods may be configured with various sizes and shapes. Examples of shapes include, but are not limited to: square shapes, rectangular shapes, elliptical shapes, triangular shapes, regular shapes, irregular shapes as well as other types of shapes. In an exemplary embodiment, first sole pod 311 is configured with an arch-like shape. Also, second sole pod 312 and third sole pod 313 are configured with rectangular-like shapes with curved portions disposed adjacent to arch portion 108 of sole 105. With this configuration, plurality of sole pods 310 may cover a substantial portion of peripheral portion 111 of forefoot portion 103.

In some embodiments, sole pods may be associated with additional portions of a sole. In an exemplary embodiment, plurality of sole pods 310 includes heel sole pod 314. Heel sole pod 314 may be disposed on heel portion 104 of sole 105.

In different embodiments, heel sole pod 314 may be disposed in various locations on heel portion 104. In some embodiments, heel sole pod 314 may be disposed on central portion 112 and/or peripheral portion 111 of heel portion 104. In one embodiment, heel sole pod 314 may be disposed on peripheral portion 111 of heel portion 104.

In an exemplary embodiment, heel sole pod 314 may be configured with a horseshoe-like shape. With this horseshoe-like shape, heel sole pod 314 may cover a substantial portion of peripheral portion 111 of heel portion 104. Using this arrangement, heel sole pod 314 can provide substantially continuous traction with a ground surface on peripheral portion 111 of heel portion 104.

In the exemplary embodiment discussed here, flexibility and traction are achieved using flex grooves and sole pods, respectively. However, it should be understood that in other embodiments flexibility and traction can be achieved using other provisions. In other words, the use of flex grooves may be optional in some embodiments. Similarly, the use of sole pods may be optional in some embodiments.

In another embodiment, a sole may be made of a material that improves both flexibility and traction for the sole. In one embodiment, for example, a sole may be made of a material comprising rubber and foam. By using a material that is both flexible and durable, the flexibility of the sole can be increased without the use of flex grooves. Furthermore, by using a material that includes rubber, the traction of the sole can be increased without the use of additional sole pads.

An article of footwear can include provisions to enable pivoting and sliding. By facilitating pivoting and sliding, an article of footwear can assist in the execution of various dance moves. In some embodiments, a pivot portion may be disposed adjacent to a ball of a foot. In other embodiments, a pivot portion may be disposed on a peripheral portion of a forefoot portion of a sole. In still other embodiments, a pivot portion may be disposed in a central portion of a forefoot portion of a foot. With this configuration, the pivot portion can facilitate sliding as well as pivoting on the central portion of the forefoot.

Figure 5:
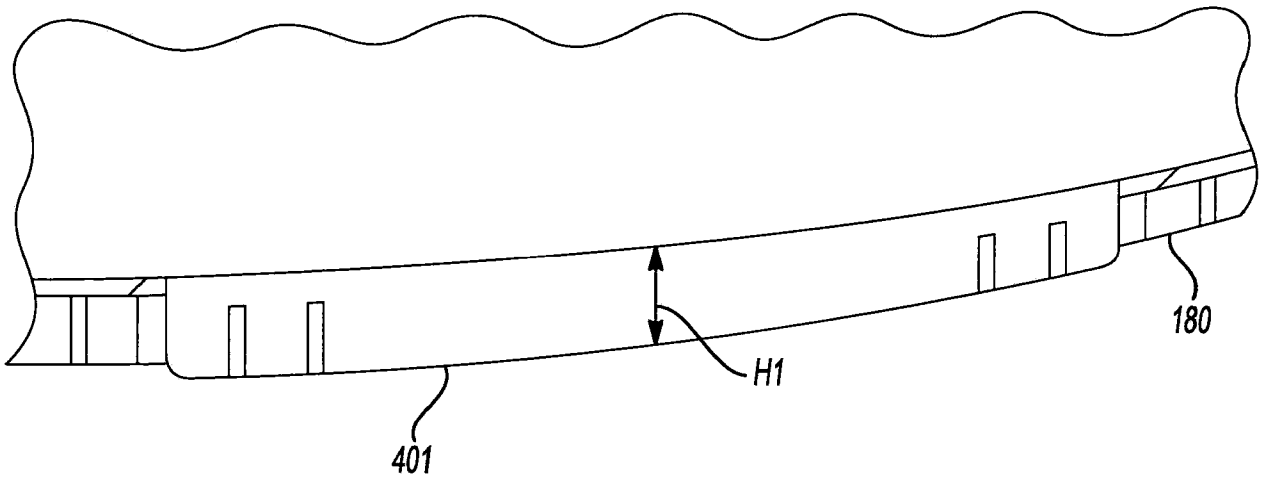
FIG. 5 is an enlarged view of an embodiment of a cross sectional profile of a central portion of a forefoot portion of a sole.

Referring to FIGS. 4 and 5, forefoot portion 103 includes pivot portion 401 to enable pivoting and/or sliding. In particular, pivot portion 401 may be disposed in central portion 112 of forefoot portion 103. In some embodiments, longitudinal flex groove 131 may extend from pivot portion 401 to heel portion 104 of sole 105, as illustrated in FIG. 3. In some cases, first flex groove set 121 may be arranged in a cross-hair like pattern around pivot portion 401. Furthermore, plurality of sole pods 310 may partially surround pivot portion 401.

In different embodiments, pivot portion 401 may be configured in various shapes. Examples of shapes include but are not limited to: circular shapes, rectangular shapes, square shapes, geometric shapes, regular shapes as well as irregular shapes. In one embodiment, pivot portion 401 comprises an ellipse-like shape.

Generally, pivot portion 401 may be configured with various sizes. In some embodiments, pivot portion 401 may be configured with a greater size in a lateral direction than a longitudinal direction. In other embodiments, pivot portion 401 may be oriented in a diagonal direction so that pivot portion 401 comprises a greater size in a diagonal direction than either a lateral or longitudinal direction. In an exemplary embodiment, pivot portion 401 comprises a greater size in a longitudinal direction than a lateral direction. In other words, the ellipse-like shape of pivot portion 401 is oriented in a longitudinal direction on sole 105.

In different embodiments, pivot portion 401 may be flush, recessed or raised with respect to bottom surface 180 of sole 105. In some embodiments, pivot portion 401 may be raised with respect to substantially flat bottom surface 180 of sole 105. In some embodiments, pivot portion 401 may be configured to resist depression when the full weight of the wearer is on forefoot portion 103. In an exemplary embodiment, pivot portion 401 may be configured to depress slightly when the full weight of a wearer is on forefoot 103.

Referring to FIG. 5, pivot portion 401 may be configured with height H1 with respect to substantially flat bottom surface 180. Generally, height H1 can be various values configured to raise pivot portion 401 above substantially flat bottom surface 180. In some embodiments, height H1 may have a value that allows pivot portion 401 to contact a ground surface without plurality of sole pods 310 contacting the ground surface. In an exemplary embodiment, height H1 may have a value that raises pivot portion 401 above bottom surface 180 but still allows plurality of sole pods 310 to contact the ground surface when the full weight of a wearer is on forefoot portion 103.

A sole of an article of footwear can include provisions for facilitating contact with a ground surface when the article is in different positions. In some embodiments, a sole can have varying coefficients of friction associated with different portions of the sole. In other words, some portions of a sole can have higher coefficients of friction than other portions of the sole. For example, in some embodiments, a periphery of a sole can be stickier than a pivot portion. With this arrangement, a dancer can easily drag a foot over a ground surface by engaging the pivot portion of the sole. Also, the dancer can easily gain increased traction with the ground surface by engaging the peripheral portion of the sole. This allows a dancer to seemingly "glide" across the ground surface during some dance moves and also to perform other types of moves that require a large degree of friction with the ground surface.

In one embodiment, pivot portion 401 can be associated with a first coefficient of friction. Similarly, sole pods of plurality of sole pods 310 may be associated with a second coefficient of friction. The first coefficient of friction may be substantially less than the second coefficient of friction. With this configuration, pivot portion 401 may allow a wearer to easily drag article of footwear 100 across a ground surface. Also, plurality of sole pods 310 can provide greater traction capabilities for a wearer by engaging peripheral portion 111 with a ground surface.

Generally, each component of article of footwear 100 may be constructed of any material. Sole system 105 may be constructed from any suitable material, including but not limited to: elastomers, siloxanes, natural rubber, other synthetic rubbers, aluminum, steel, natural leather, synthetic leather, or plastics. Sole pods of plurality of sole pods 310 may be made of materials with a high coefficient of friction, including, but not limited to: elastomers, siloxanes, natural rubber, other synthetic rubbers as well as other materials. In an exemplary embodiment, sole pods of plurality of sole pods 310 may be made of rubber. In addition, pivot portion 401 can be made of materials with a low coefficient of friction, including, but not limited to: low friction rubber, plastics, polyurethane as well as other materials. In some cases, central portion 112 of forefoot portion 103 may comprise a similar material as pivot portion 401. In other cases, central portion 112 of forefoot portion 103 may comprise a different material than pivot portion 401.

In embodiments where article 100 is a dance shoe, the low coefficient of friction of pivot portion 401 can allow a dancer to slide or drag article 100 across a ground surface. As a dancer plants article 100, plurality of sole pods 310 engage peripheral portion 111 with a ground surface to provide traction to prevent slipping.

Typically, when a dancer pivots, a peripheral portion of a sole may not conform to the ground surface due to the rigidity of the peripheral portion. Without conforming to the ground surface, the peripheral portion of the sole fails to provide flexibility for the dancer. For example, a rigid peripheral portion may limit the amount that a dancer may pivot. Instead, flex grooves in the peripheral portion may allow a forefoot portion to conform to a ground surface to provide greater flexibility for a dancer. In particular, the use of radially extending flex grooves may allow the sole to flex in many different directions during pivoting motions. In contrast, flex grooves oriented in a single direction with respect to the sole may only provide bending of the sole in a particular direction.

Figure 6:
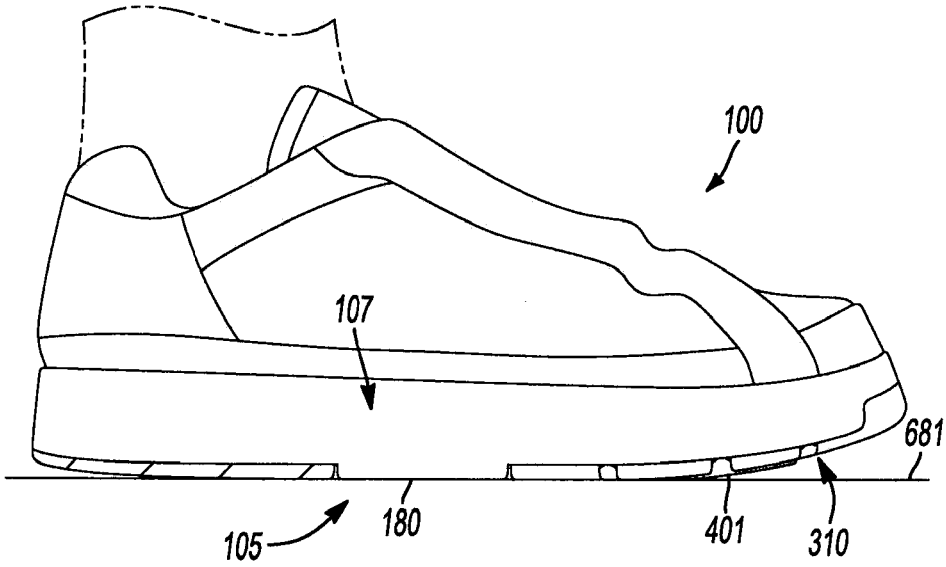
FIG. 6 is a side view of an embodiment of an article of footwear in a substantially flat position with a ground surface.
Figure 7:
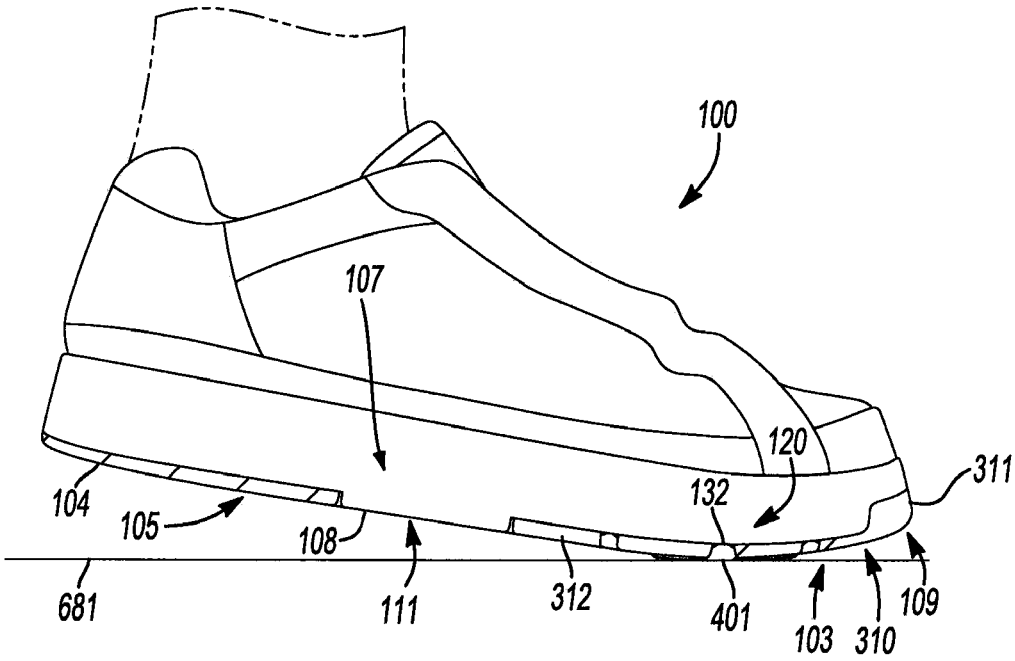
FIG. 7 is a side view of an embodiment of an article of footwear pivoting forward.

FIGS. 6-9 illustrate an embodiment of article of footwear 100 pivoting in various directions. In particular, FIGS. 6 and 7 illustrate a lateral side view of an embodiment of article of footwear 100 pivoting forward. Referring to FIG. 6, article of footwear 100 is in a substantially flat position. In the substantially flat position, bottom surface 180 of sole 105 is substantially flush with ground surface 681. In particular, pivot portion 401 and plurality of sole pods 310 are in contact with ground surface 681.

Referring to FIG. 7, heel portion 104 and arch portion 108 rise from ground surface 681 as a dancer pivots article 100 forward onto pivot portion 401. As the dancer pivots onto pivot portion 401, plurality of flex grooves 120 disposed on peripheral portion 111 flex to adapt to the pivoting of article 100. For example, lateral flex groove 132 flexes to allow a portion of second sole pod 312 to rise from ground surface 681 to adapt to the forward pivoting of article 100. Third sole pod 313, not shown for purposes of clarity, may also rise from ground surface 681 as lateral flex groove 132 flexes to accommodate the pivoting. Furthermore, other flex grooves of plurality of flex grooves 120, not shown for purposes of illustration, can also flex to adapt to the pivoting and enable a portion of forefoot portion 103 to rise from ground surface 681. By adapting to the pivoting of article 100, plurality of flex grooves 120 allow peripheral portion 111 to bend away from pivot portion 401, which allows a dancer to more easily turn on pivot portion 401. Additionally, this arrangement allows a dancer to smoothly glide their feet by dragging the article across a ground surface with only the pivot portion exposed to the surface, which allows for significantly less friction than when the sole pods are engaged.

A sole can include provisions for enhancing forefoot rotational traction, which allows a dancer to pivot and stop. In some cases, sole pods 310 may enhance the ability of a dancer to pivot and stop. In other words, sole pods 310 can provide a breaking traction at peripheral portion 111 during a pivoting motion. In other embodiments, however, forefoot rotational traction can be achieved in other manners. For example, in another embodiment, using a midsole with a high degree of traction can facilitate pivoting and stopping.

Figure 8:
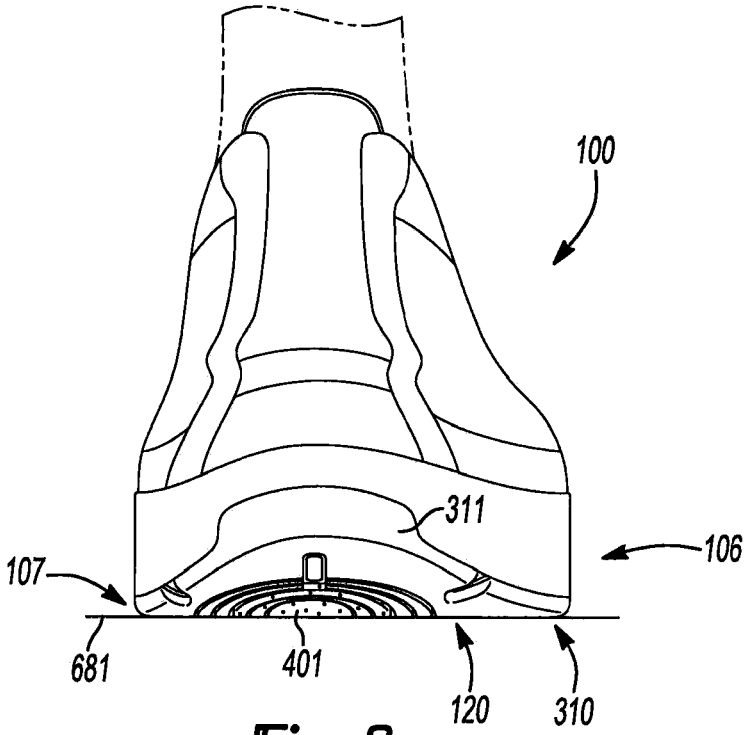
FIG. 8 is a front view of an embodiment of an article of footwear in a substantially flat position with a ground surface.
Figure 9:
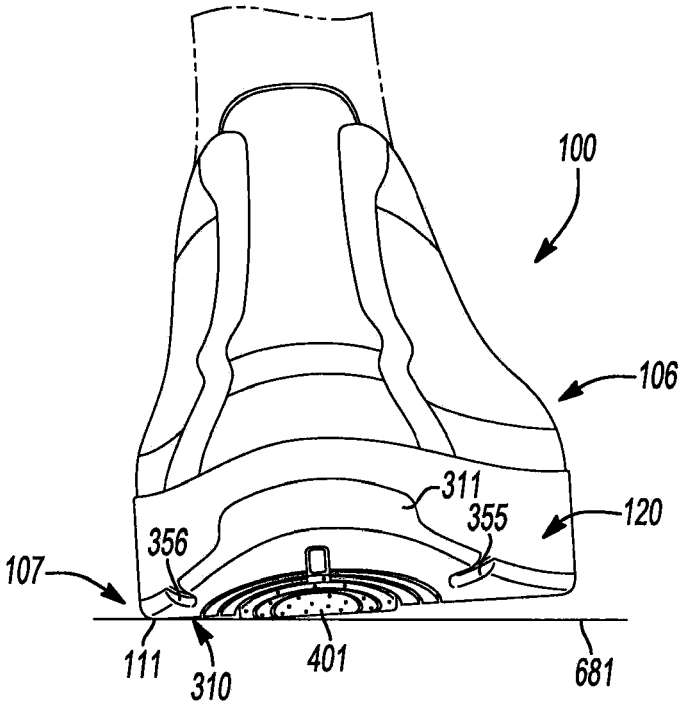
FIG. 9 is a front view of an embodiment of an article of footwear pivoting to a lateral side.

Referring to FIGS. 8 and 9, article 100 moves from a substantially flat position to a laterally pivoting position. In particular, FIG. 8 illustrates a front isometric view of an embodiment of article 100 in a substantially flat position. In this substantially flat position, plurality of sole pods 310 and pivot portion 401 contact ground surface 681.

Referring to FIG. 9, a dancer may pivot article 100 by some amount and then stop. In this embodiment, a dancer can press lateral portion 107 of peripheral portion 111 against ground surface 681. In particular, one or more of sole pods 310 may engage ground surface 681 to provide enhanced traction and stopping ability. It should be understood that in some cases other portions of peripheral portion 111 may engage ground surface 681 to stop a pivoting motion. With this arrangement, a dancer can perform quick and precise pivoting moves in various directions.

In some cases, the flexibility of sole 105 can enhance the stability of article 100 as a dancer leans on peripheral portion 111 to stop a pivoting motion. In some cases, medial portion 106 may rise from ground surface 681 as a dancer pivots onto lateral portion 107. With the flexibility provided by plurality of flex grooves 120, lateral portion 107 of peripheral portion 111 conforms to ground surface 681 instead of tipping over onto a peripheral edge of peripheral portion 111. In one embodiment, fifth flex groove 355 and sixth flex groove 356 both flex to facilitate this pivoting motion. Although not shown for purposes of clarity, it should be understood that additional flex grooves of plurality of flex grooves 120 may also flex as a dancer pivots. Using this arrangement, lateral portion 107 of peripheral portion 111 may remain engaged with ground surfaced 681 to provide increased traction for a dancer pivoting to a lateral side. It should be understood that plurality of flex grooves 120 can also accommodate medial pivoting in a similar manner.

By using a pivot portion in combination with a highly flexible forefoot portion, a dancer can more easily pivot in substantially any direction as the sole may bend to enhance contact between the pivot portion and the ground. Furthermore, providing increased traction along a peripheral portion of the sole enhances the ability of a dancer to pivot and stop.

Figure 10:
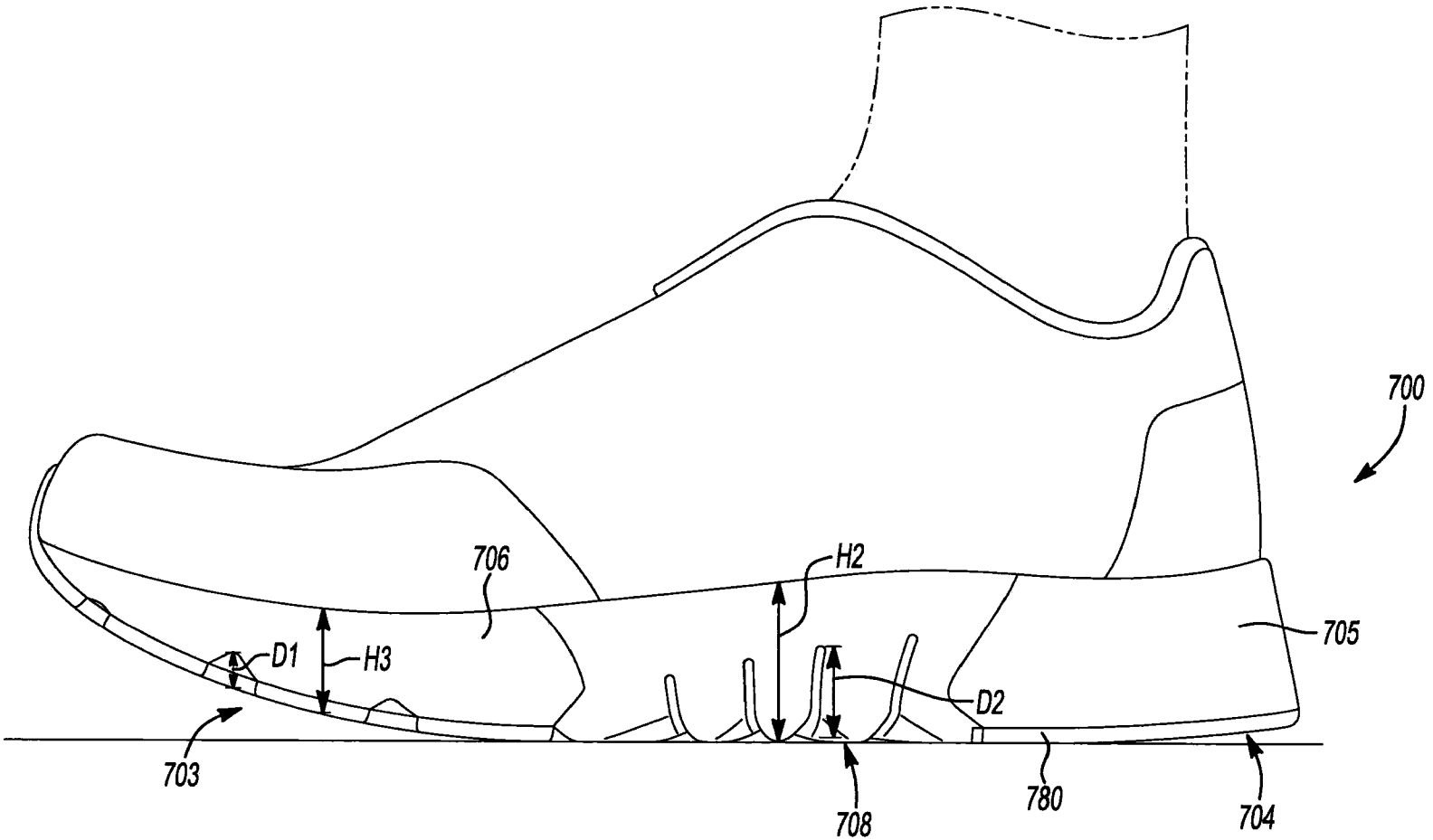
FIG. 10 is a side view of an embodiment of an article of footwear.
Figure 11:
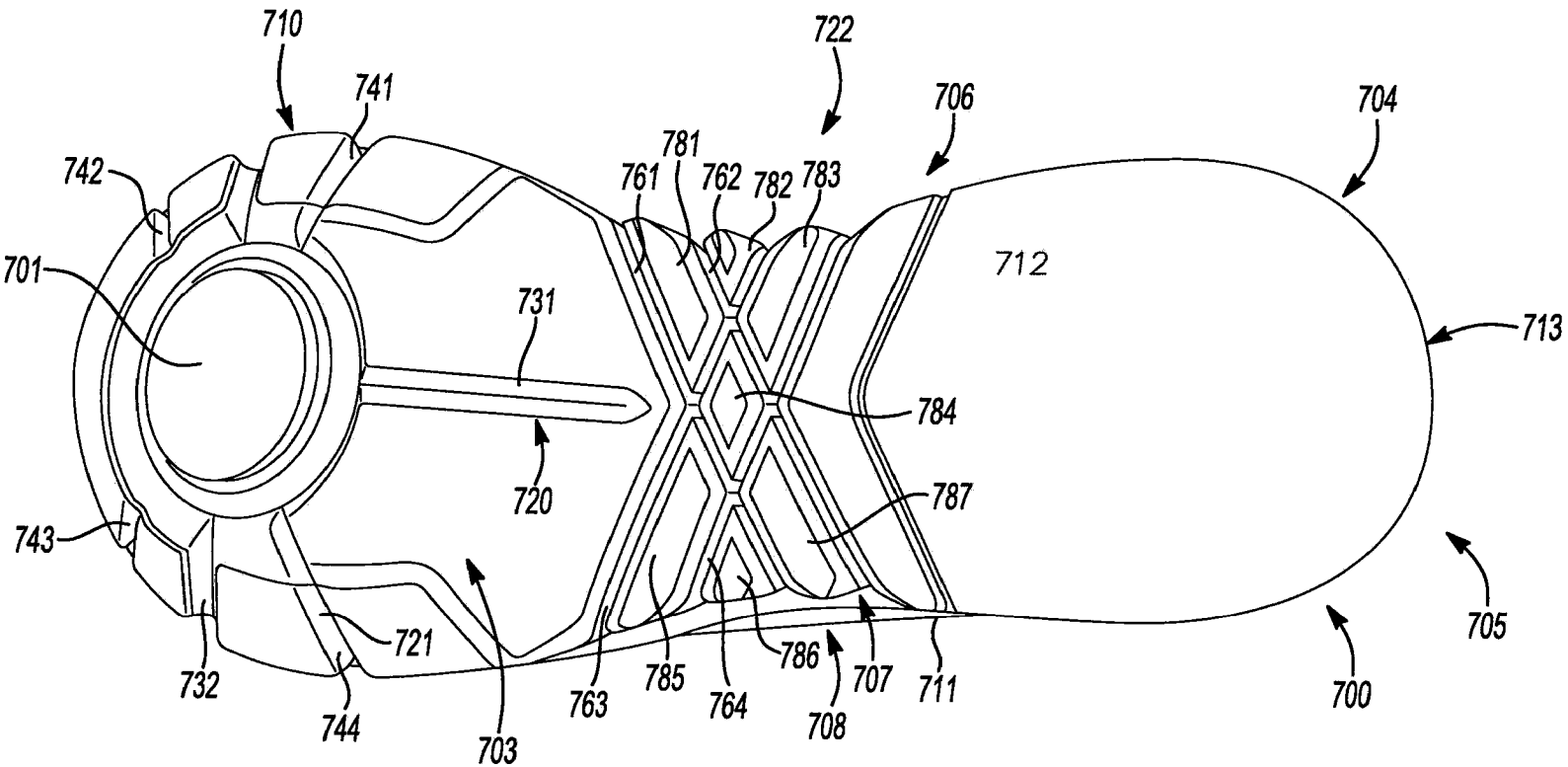
FIG. 11 is a bottom view of an embodiment of an article of footwear.

FIGS. 10 and 11 illustrate an exemplary embodiment of article 700. In particular FIG. 10 is a side view of an embodiment of article 700 and FIG. 11 is a bottom view of an embodiment of article 700. In one embodiment, article 700 may be configured with similar features discussed in respect to article 100 of the previous embodiment. In particular, sole 705 of article 700 includes pivot portion 701 to facilitate pivoting and sliding.

In some embodiments, sole 705 includes plurality of sole pods 710. Plurality of sole pods 710 may be disposed on peripheral portion 711 of sole 705. In particular, plurality of sole pods 710 includes three sole pods disposed on forefoot portion 703 of sole 705. Also, plurality of sole pods 710 comprises heel sole pod 713 disposed on heel portion 704 of sole 705. With this arrangement, plurality of sole pods 710 can provide substantially continuous traction on peripheral portion 711 of forefoot portion 703 and heel portion 704 of sole 705.

In some embodiments, sole 705 may also include plurality of flex grooves 720 to facilitate bending of sole 705. Referring to FIG. 11, plurality of flex grooves 720 includes first flex groove set 721. First flex groove set 721 is disposed on forefoot 703 of sole 705. In some cases, first flex groove set 721 includes longitudinal flex groove 731 and lateral flex groove 732. Similar to the previous embodiment of article 100, lateral flex groove 732 extends in a lateral direction across forefoot 703. Likewise, longitudinal flex groove 731 extends in a longitudinal direction on sole 705. However, in this embodiment, longitudinal flex groove 731 extends only through forefoot portion 703 and a portion of arch portion 708 of sole 705.

In some embodiments, first flex groove set 721 includes first flex groove 741, second flex groove 742, third flex groove 743 and fourth flex groove 744. First flex groove 741, second flex groove 742, third flex groove 743 and fourth flex groove 744, as well as longitudinal flex groove 731 and lateral flex groove 732, extend in a radial direction from pivot portion 701. In particular, plurality of flex grooves 720 is arranged in a cross-hair like pattern around pivot portion 701. With this arrangement, plurality of sole pods 710 can facilitate the bending of central portion 712 of sole 705 and peripheral portion 711.

An article of footwear can include provisions for increasing the flexibility of an arch portion of a sole. In some embodiments, an arch portion of a sole may comprise a flexible material to increase the flexibility of the arch portion of the article. In other embodiments, an arch portion of a sole may be configured with flex grooves to increase the flexibility of the arch portion of the sole. With this arrangement, an arch portion of a sole may have increased flexibility while maintaining stability of the arch portion of the sole.

In some embodiments, plurality of flex grooves 720 includes second flex groove set 722. Second flex groove set 722 is associated with arch portion 708 of sole 705. Generally, second flex groove set 722 may be associated with various numbers of flex grooves. In some cases, second flex groove set 722 may include more than four flex grooves. In other cases, second flex groove set 722 can include less than four flex grooves. In one embodiment, second flex groove set 722 includes four flex grooves. In particular, second flex groove set 722 includes first flex groove 761, second flex groove 762, third flex groove 763 and fourth flex groove 764.

Generally, second flex groove set 722 maybe arranged in various patterns on arch portion 708. In some embodiments, flex grooves of second flex groove set 722 may be arranged so that the flex grooves do not intersect. In other embodiments, flex grooves of second flex groove set 722 may be arranged with intersecting flex grooves. In one embodiment, second flex groove set 722 may be arranged with flex grooves intersecting in an "x"-like configuration.

In an exemplary embodiment, first flex groove 761 and second flex groove 762 may be substantially parallel with each other. In particular, first flex groove 761 and second flex groove 762 may extend diagonally from medial portion 706 of sole 705 to lateral portion 707 of sole 705. In a similar manner, third flex groove 763 and fourth flex groove 764 can be arranged substantially parallel with each other. In particular, third flex groove 763 and fourth flex groove 764 may extend diagonally from lateral portion 707 to medial portion 706. With this arrangement, flex grooves of second flex groove set 722 may intersect to form an "x"-like configuration.

In embodiments with intersecting flex grooves of second flex groove set 722, arch portion 708 may also include first portion 781, second portion 782 and third portion 784. First portion 781, second portion 782 and third portion 783 may be associated with medial portion 706 of peripheral portion 711. In particular, first portion 781 may be disposed adjacent to first flex groove 761 and second flex groove 762 as third flex groove 763 intersects first flex groove 761 and second flex groove 762. Similarly, second portion 782 may be disposed adjacent to the intersection of second flex groove 762 and third flex groove 763. Likewise, third portion 783 may be disposed adjacent to third flex groove 763 and fourth flex groove 764 as second flex groove 762 intersects third flex groove 763 and fourth flex groove 764.

In addition, arch portion 708 may also include fourth portion 784. Fourth portion 784 may be circumscribed by the four intersections of second flex groove set 722. With this arrangement, fourth portion 784 may be associated with central portion 712 of arch portion 708.

Arch portion 708 may also include fifth portion 785, sixth portion 786 and seventh portion 787. In one embodiment, fifth portion 785, sixth portion 786 and seventh portion 787 may be associated with lateral portion 707 of sole 705. In particular, fifth portion 785 may be disposed on lateral portion 707 adjacent to third flex groove 763 and fourth flex groove 764 as third flex groove 763 and fourth flex groove 764 intersect first flex groove 761. Likewise, sixth portion 786 may be disposed adjacent to the intersection of fourth flex groove 764 and first flex groove 761. Also, seventh portion 787 may be disposed adjacent to first flex groove 761 and second flex groove 762 as first flex groove 761 and second flex groove 762 intersect with fourth flex groove 764.

This arrangement of plurality of flex grooves 720 can enable bending and twisting of portions of arch portion 708. However, with a limited number of flex grooves, plurality of flex grooves 720 may not interfere with the stability of arch portion 708. With this arrangement, plurality of flex grooves 720 can accommodate some twisting and bending while maintaining stability of arch portion 708.

An article of footwear can include provisions for varying flexibility over different portions of a sole. In some embodiments, flex grooves with varying widths can be disposed in different portions of a sole to vary the flexibility of different portions of the sole. In other embodiments, flex grooves comprising different average depths can be disposed in different portions on a sole to vary the flexibility of different portions of the sole. In some cases, flex grooves with greater depths may accommodate greater flexibility than more shallow flex grooves.

Referring to FIG. 10, first flex groove set 721 may be associated with first average depth D1. The term "average depth" as used throughout this detailed description and in the claims, refers to an average depth of a set of flex grooves as the flex grooves extend from a bottom surface of the sole into the sole. In other words, flex grooves of first flex groove set 721 extend various depths from bottom surface 780 of sole 705 into sole 705. These depths may be averaged to associate first flex groove set 721 with first average depth D1. In a similar manner, second flex groove set 722 can be associated with second average depth D2.

Although average depth D2 is associated with second flex groove set 722, it should be understood that the depths of flex grooves of second flex groove set 722 may vary. In some embodiments, flex grooves of second flex groove set 722 may have a shallower depth when disposed adjacent to forefoot portion 703. Likewise, flex grooves of second flex groove set 722 may have a greater depth when disposed adjacent to heel portion 704. In one embodiment, first flex groove 761 disposed adjacent to forefoot portion 703 on medial portion 706 may have a more shallow depth than fourth flex groove 764 disposed adjacent to heel portion 704 on medial portion 706. Using this arrangement, second flex groove set 722 may provide greater flexibility to a portion of arch portion 708 adjacent to heel portion 704 than a portion of arch portion 708 adjacent to forefoot portion 703.

The height of sole 705 may also vary and accommodate different depths of flex grooves. In some embodiments, sole 705 may comprise second height H2 at arch portion 708. In addition, sole 705 may be configured with third height H3 at forefoot portion 703. In some cases, second height H2 at arch portion 708 may be a relatively tall height. In contrast, sole 705 may comprise a more shallow third height H3 at forefoot portion 703.

In some embodiments, second average depth D2 of second flex groove set 722 may be less than first average depth D1 of first flex groove set 721. In still other embodiments, second average depth D2 may be substantially equal to first average depth D1. In an exemplary embodiment, first average depth D1 may be substantially less than second average depth D2. In some cases, first average depth D1 may be a value corresponding to relatively deep flex grooves. This may allow second flex groove set 722 to provide more flexibility for arch portion 708 than first flex groove set 721 provides for forefoot portion 703. With this arrangement, forefoot portion 703 may have more stability than arch portion 708.

Figure 12:
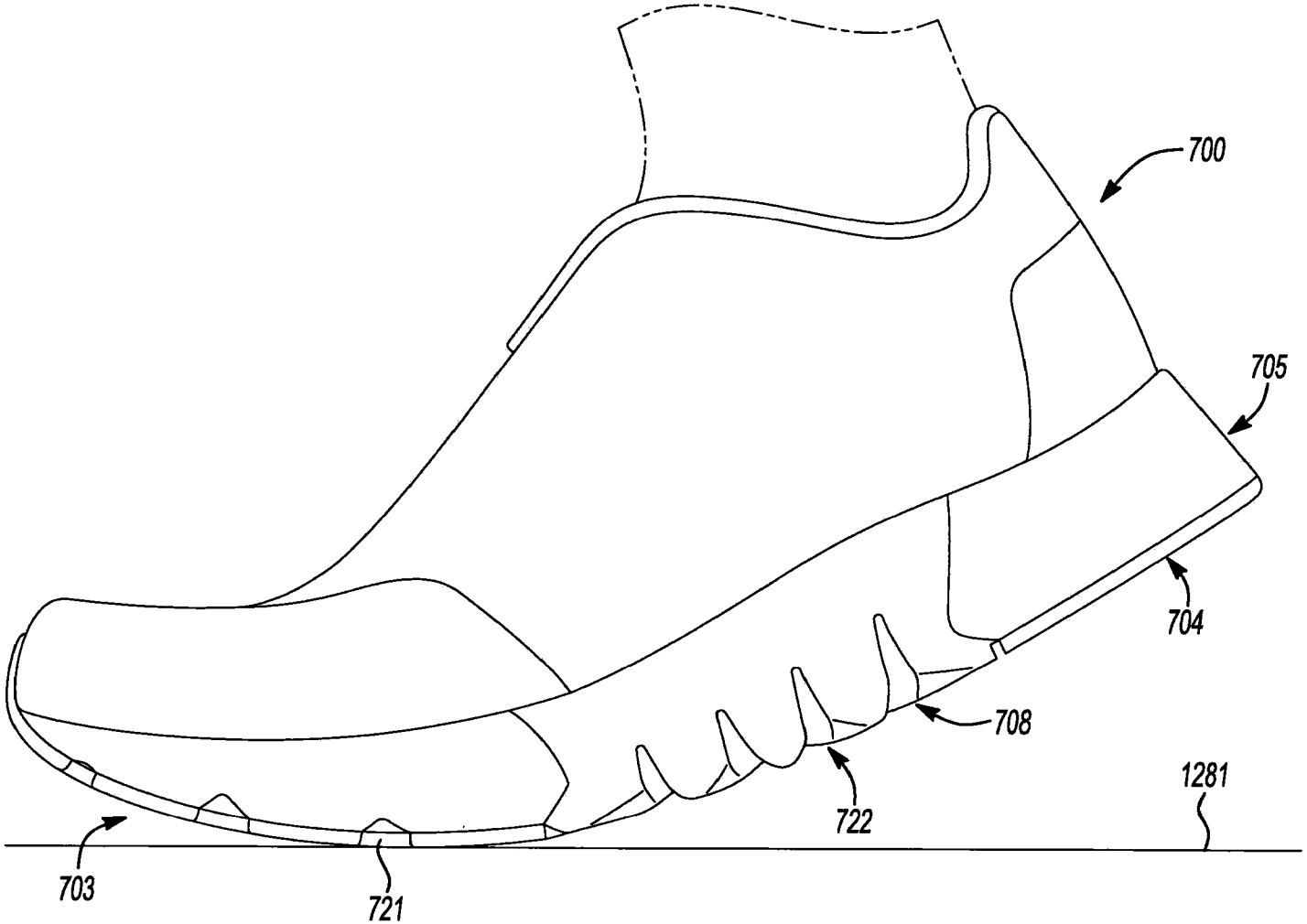
FIG. 12 is a side view of an embodiment of an article of footwear undergoing flexing.

In order to support a dancer when the dancer places a substantial portion of weight on a forefoot, the forefoot portion of a sole can be configured to provide stability. Referring to FIG. 12, a dancer plants forefoot portion 703 on ground surface 1281 while raising arch portion 708 and heel portion 704 off of ground surface 1281. In particular, flex grooves of second flex groove set 722 flex to allow arch portion 708 to bend. In contrast, first flex groove set 721 does not interfere with the stability of forefoot portion 703. With this arrangement, sole 705 provides flexibility and stability for a dancer wearing article of footwear 700.

Flex grooves can be configured to accommodate bending in a first direction while preventing bending in a second direction. In some embodiments, relatively deep flex grooves disposed in a tall sole may accommodate bending in a first direction while preventing bending in a second direction. In some cases, flex grooves can assist in preventing pronation of a foot by preventing bending in a second direction.

Second flex groove set 722 may accommodate bending in a first bending direction. The term "first bending direction" as used in this detailed description and in the claims, refers to the direction associated with a toe portion moving upwards towards a shin. In some cases, second flex groove set 722 may accommodate bending in a first bending direction when article 700 arches to raise heel portion 704, as illustrated in FIG. 12.

As previously discussed, arch portion 708 is configured with a relatively tall second height H2. In addition, flex grooves of second flex groove set 722 have a relatively deep depth D1. This arrangement can allow second flex groove set 722 to substantially prevent bending in a second bending direction. The term "second bending direction" as used in this detailed description and in the claims, refers to the direction associated with a pointed forefoot portion moving toward a heel portion of a foot.

Figure 13:
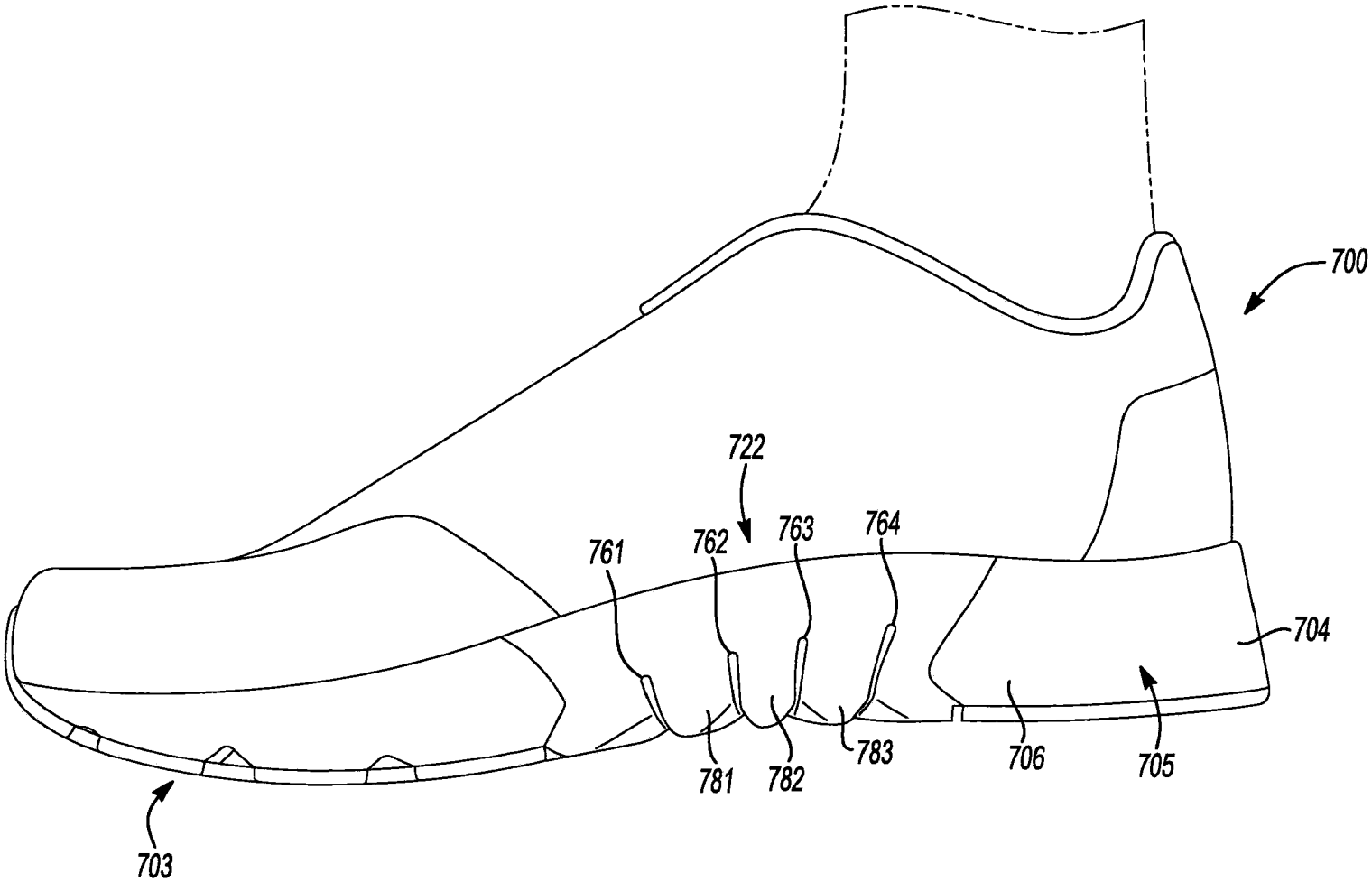
FIG. 13 is a side view of an embodiment of an article of footwear undergoing flexing.

Referring to FIG. 13, a dancer is moving article 700 in a second bending direction. As the dancer attempts to move forefoot portion 703 toward heel portion 704, flex grooves of second flex groove set 722 may be pinched together by adjacent portions to prevent further movement in a forward rotating direction. For example, first flex groove 761 may be pinched together on medial portion 706 by an adjacent portion of arch portion 708 and first portion 781. Likewise, second flex groove 762 may be pinched together on medial portion 706 by adjacent first portion 781 and second portion 782. Also, third flex groove 763 may be pinched together on medial portion 706 by adjacent second portion 782 and third portion 783. Finally, fourth flex groove 764 may be pinched together on medial portion 706 by third portion 783 and an adjacent portion of arch portion 708. Although only medial portion 706 is illustrated in FIG. 13 for purposes of clarity, it should be understood that flex grooves of second flex groove set 722 may also be pinched together on central portion 712 and lateral portion 707. As flex grooves of second flex groove set 722 are pinched together, second flex groove set 722 substantially prevents further movement in a second bending direction. With this arrangement, second flex groove set 722 may substantially reduce pronation of a foot disposed within article 700.

In different embodiments the depth of one or more flex grooves can vary. In some cases, each flex groove of a flex groove set can have a substantially constant depth. In other cases, the depth of one or more flex grooves can vary along the length of the flex groove. Furthermore, different flex grooves of a flex groove set can have substantially different depths.

Figure 14:
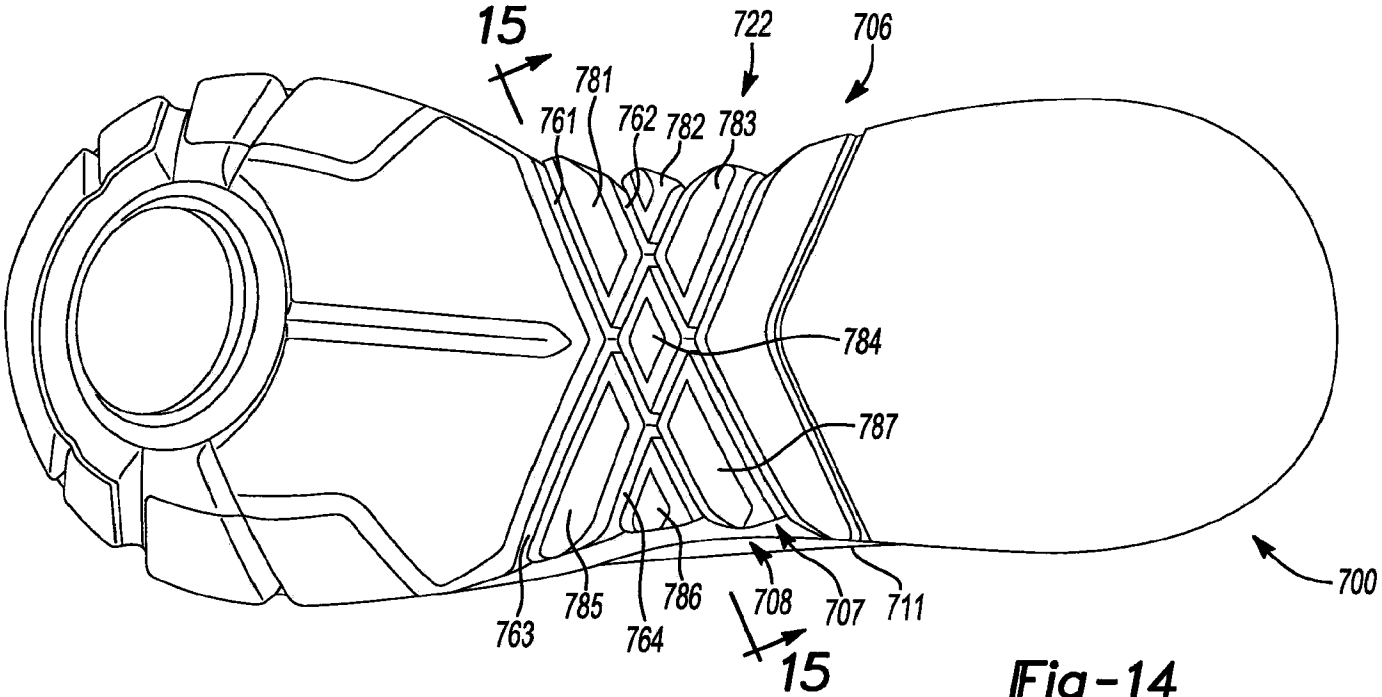
FIG. 14 is an isometric bottom view of an embodiment of an article of footwear.
Figure 15:
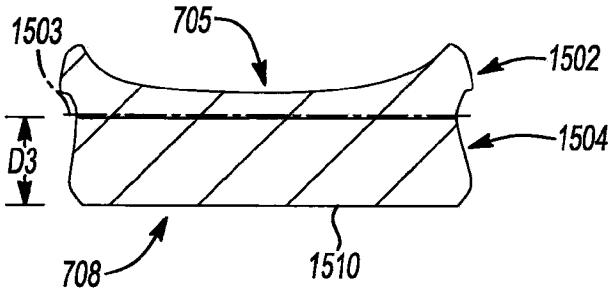
FIG. 15 is a cross sectional view of an embodiment of an article of footwear.

Referring to FIG. 14, article 700 includes first flex groove 761, as previously discussed. In this exemplary embodiment, the depth of first flex groove 761 may be substantially constant over the length of first flex groove 761. Referring to FIG. 15, sole 705 includes base portion 1502 and extended portion 1504. Base portion 1502 may be separated from extended portion 1504 by intermediate surface 1503. Generally, intermediate surface 1503 corresponds to the upper end portion of first flex groove 761. In other words, first flex groove 761 extends through lower portion 1504 but first flex groove 761 does not extend into base portion 1502. Furthermore, sole 705 includes outer sole surface 1510 that is a substantially flat ground engaging surface. In this embodiment, the depth of first flex groove 761 corresponds to the distance between intermediate surface 1503 and outer sole surface 1510.

As seen in FIG. 15, first flex groove 761 has a depth D3 that is substantially constant over the length of first flex groove 761. In some cases, the remaining flex grooves of second flex groove set 722 can have substantially similar constant depths. As previously discussed, this arrangement allows for increased flexibility in a first direction associated with a toe portion extended upwards and towards a shin.

Figure 16:
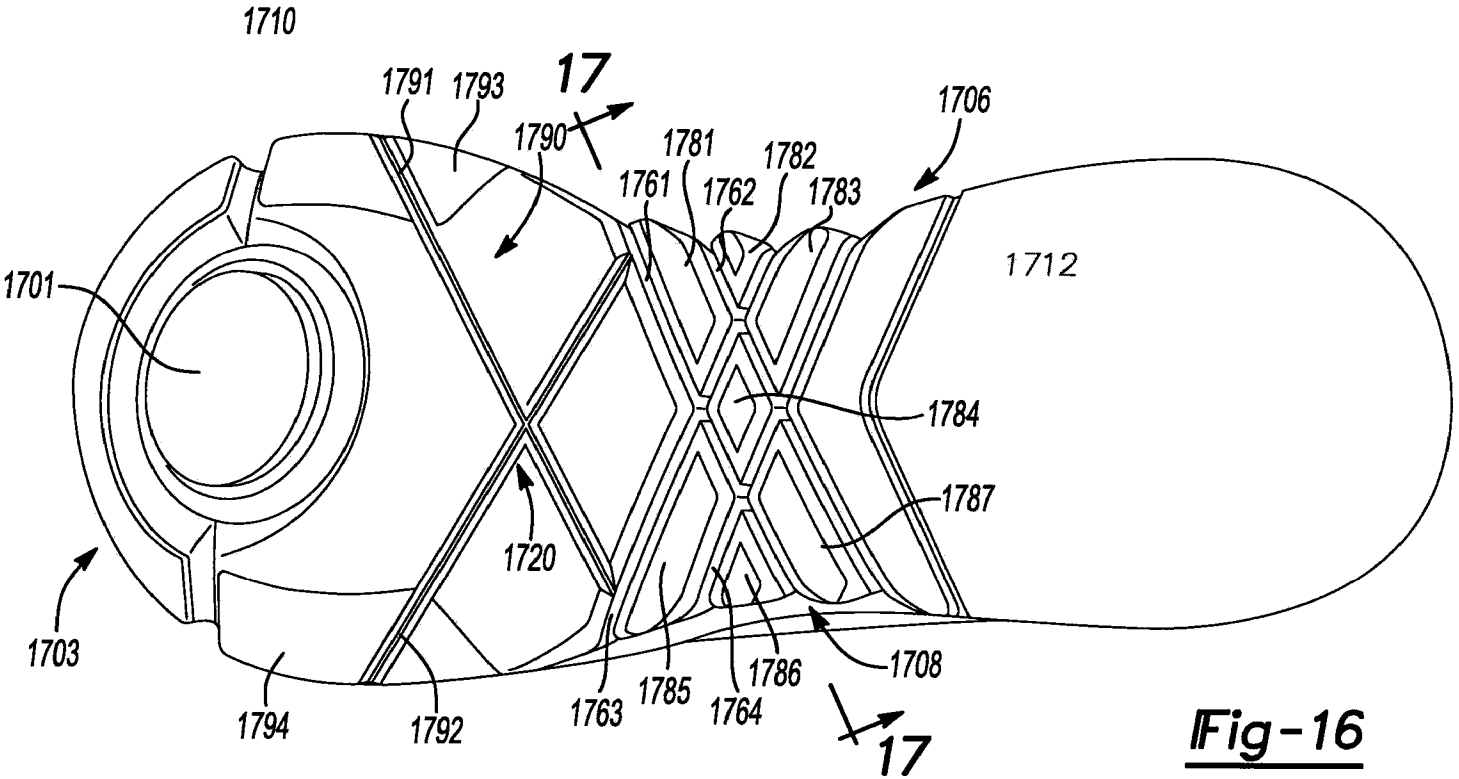
FIG. 16 is an isometric bottom view of an embodiment of an article of footwear.
Figure 17:
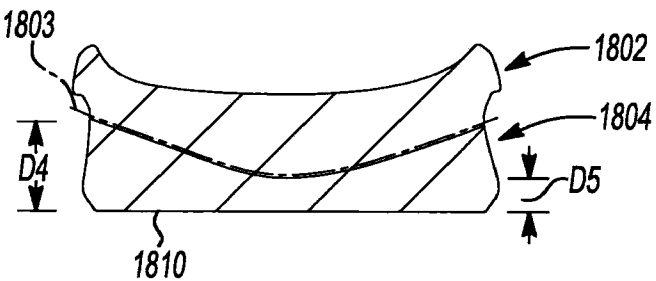
FIG. 17 is a cross sectional view of an embodiment of an article of footwear.

In another embodiment, illustrated in FIGS. 16 and 17, the depth of a flex groove may vary along the length of the flex groove. Referring to FIG. 16, article 1700 is another embodiment of a dance shoe. In particular, article 1700 may include some or all of the features associated with previous embodiments discussed in this detailed description. For example, sole 1706 of article 1700 can include pivot portion 1701, first flex groove set 1711 and plurality of sole pods 1710.

Furthermore, article 1700 can include second flex groove set 1712 disposed on arch portion 1708. Second flex groove set 1712 comprises first flex groove 1761, second flex groove 1762, third flex groove 1763 and fourth flex groove 1764. In some cases, each flex grooves of second flex groove set 1712 can be arranged in a similar manner to the flex grooves of the previous embodiments. In particular, second flex groove set 1712 may divide arch portion 1708 into first portion 1781, second portion 1782, third portion 1783, fourth portion 1784, fifth portion 1785, sixth portion 1786 and seventh portion 1787, each of which can articulate partially independently.

In this embodiment, one or more flex grooves of second flex groove set 1712 may have a non-constant depth. For example, in some cases, first flex groove 1761 may have a depth that varies over the length of first flex groove 1761. Referring to FIG. 17, sole 1706 may include base portion 1802 and extended portion 1804 that are separated by intermediate surface 1803. Furthermore, sole 1706 includes outer sole surface 1810 that may be a substantially flat ground engaging surface. In this embodiment, the depth of first flex groove 1761 corresponds to the distance between intermediate surface 1803 and outer sole surface 1810.

In this embodiment, first flex groove 1761 has a variable depth. In particular, first flex groove 1761 has a depth D4 at first peripheral edge 1821 and second peripheral edge 1822 of sole 1706. Likewise, first flex groove 1761 has a depth D5 at central portion 1824, which is disposed between first peripheral edge 1821 and second peripheral edge 1822. Furthermore, the depth of first flex groove 1761 decreases between first peripheral edge 1821 and central portion 1824. Likewise, the depth of first flex groove 1761 also decreases between second peripheral edge 1821 and central portion 1824.

In different embodiments, the shape of intermediate surface 1803, which corresponds to the depth of first flex groove 1761, can vary. In particular, the cross-sectional shapes of intermediate surface 1803 can be associated with any shapes including, but not limited to, convex shapes, concave shapes, elliptic shapes, rounded shapes, polygonal shapes, triangular shapes, as well as any other types of shapes.

In addition, the depths of each flex groove associated with an arch portion of a sole can be varied along the length of the flex groove. In some cases, each flex groove of a flex groove set can have a depth that varies in a similar manner to first flex groove 1761. In other cases, however, only some flex grooves of a flex groove set may have a varying depth.

By varying the depths of one or more flex grooves, the flexibility properties of a portion of a sole can be fine tuned. For example, using a substantially constant depth for each flex groove in a flex groove set may allow for enhanced bending along an axis between a toe portion and a heel portion. In contrast, using flex grooves with depths that vary along the lengths of the flex grooves can enhance torsion properties of the sole. Furthermore, using a combination of flex grooves with varying heights and flex grooves with constant heights allows for tuning of both bending and torsion properties of a portion of a sole.

A sole can also include provisions for increasing stability in one or more portions of the sole. In some cases, for example, a sole can include one or more ribs to help enhance stability in one or more regions of a sole.

Referring to FIG. 16, article 1700 may include rib system 1790. In some cases, rib system 1790 can further include first rib member 1791 and second rib member 1792. In this embodiment, first rib member 1791 may be raised with respect to sole 1706. Likewise, second rib member 1792 may be raised with respect to sole 1706. With this arrangement, first rib member 1791 and second rib member 1792 can enhance stability of sole 1706.

In different embodiments, rib members may be associated with various portions of a sole. In some cases, rib members can be disposed on a forefoot portion of a sole. In other cases, rib members can be disposed on an arch portion of a sole. In still other cases, rib members can be disposed on a heel portion of a sole. In embodiments with flex groove sets on a forefoot portion and an arch portion of a sole, one or more rib members may be disposed on an intermediate portion of the sole disposed between the arch portion and the forefoot portion.

In this embodiment, rib system 1790 may be disposed on intermediate portion 1720 of sole 1706, which is disposed between forefoot portion 1703 and arch portion 1708. In particular, first rib member 1791 may extend from third flex groove 1763 to first sole pod 1793 in a substantially diagonal manner. Likewise, second rib member 1792 may extend from first flex groove 1761 to second sole pod 1794 in a substantially diagonal manner. With this arrangement, first rib member 1791 and second rib member 1792 may help enhance stability in intermediate portion 1720.

Figure 18:
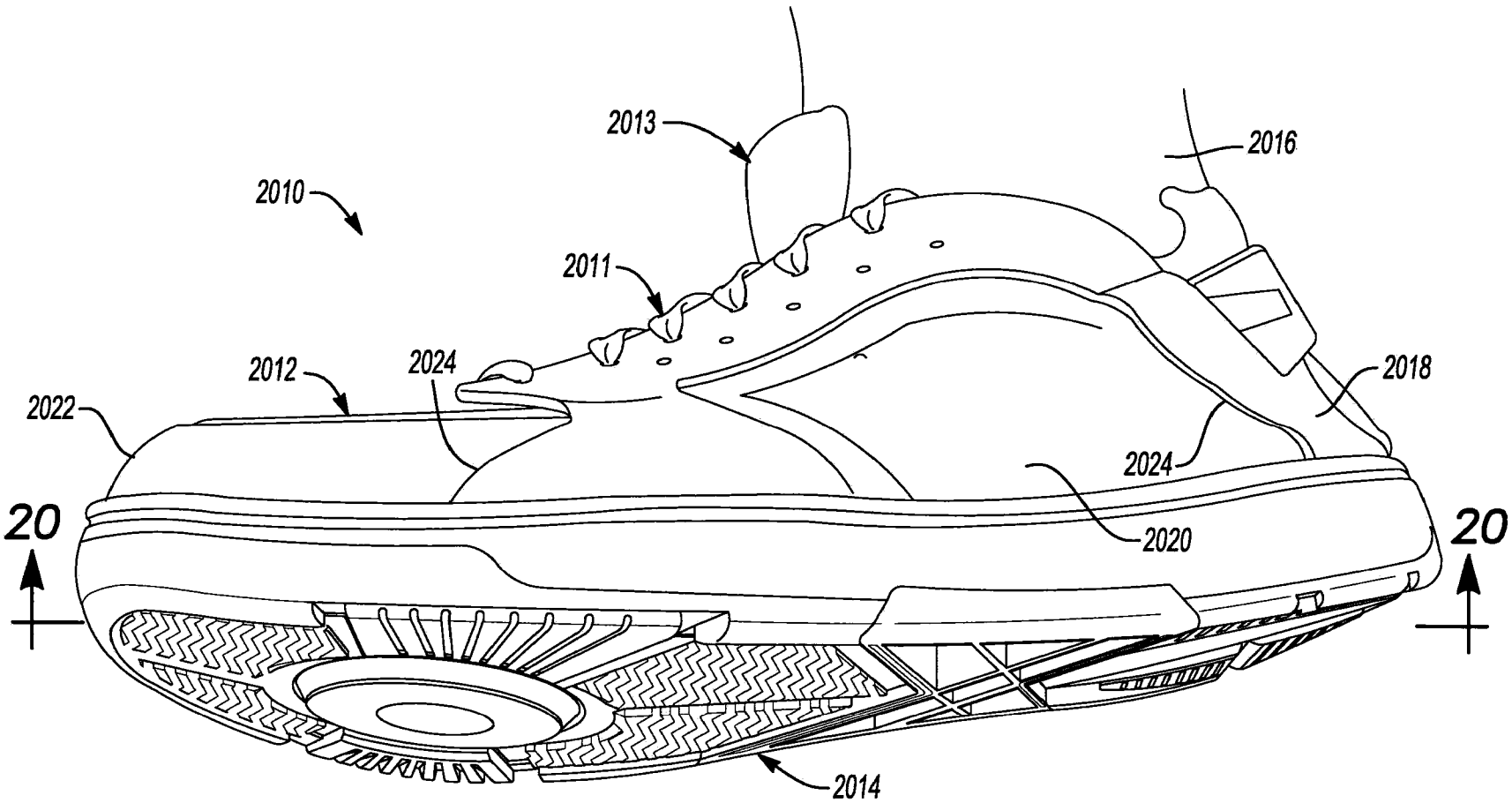
FIG. 18 is a perspective view of an article of footwear in accordance with the teachings of the present disclosure.

With reference to FIG. 18, an article of footwear 2010 is provided and includes an upper structure 2012 and a sole structure 2014. The upper structure 2012 and sole structure 2014 cooperate to provide the article of footwear 2010 with a degree of flexibility about a longitudinal axis of the article of footwear 2010. As such, the article of footwear 2010 is particularly suitable for use in an activity that requires a user's foot to flex such as, for example, dancing and aerobics.

The upper structure 2012 selectively receives a user's foot 2016 and may include a rear 2018, a vamp 2020, and a toe box 2022, joined together through stitching 2024, high frequency welding, and/or via an epoxy. The rear 2018, or back portion of the article of footwear 2010, protects a heel bone of the user's foot 2016 and minimizes relative movement between the user's foot 2016 and the article of footwear 2010 during use. The vamp 2020 generally covers the instep and protects a top portion of the user's foot 2016. The toe box 2022 may be formed from a relatively durable material to protect the upper structure 2012 from scuffing and to protect the front portion of the user's foot 2016. The upper structure 2012 may also include a fastening system 2011 for securing the article of footwear 2010 to the user's foot 2016, pockets (not shown) for storing small objects, and/or a tongue 2013 disposed proximate to the user's foot 2016 to increase the aesthetics and comfort of the article of footwear 2010.

The upper structure 2012 may be formed from a material that concurrently supports the user's foot 2016 and allows the user's foot 2016 to flex along with the sole structure 2014. Alternatively, the upper structure may be formed from a plurality of materials that cooperate to concurrently support the user's foot 2016, allow the user's foot 2016 to flex with the sole structure, and provide the article of footwear 2010 with a desired aesthetic appearance. In one configuration, such materials may include materials that provide the article of footwear 2010 with ventilation, as well as the ability to direct moisture away from the user's foot 2016.

Figure 19:
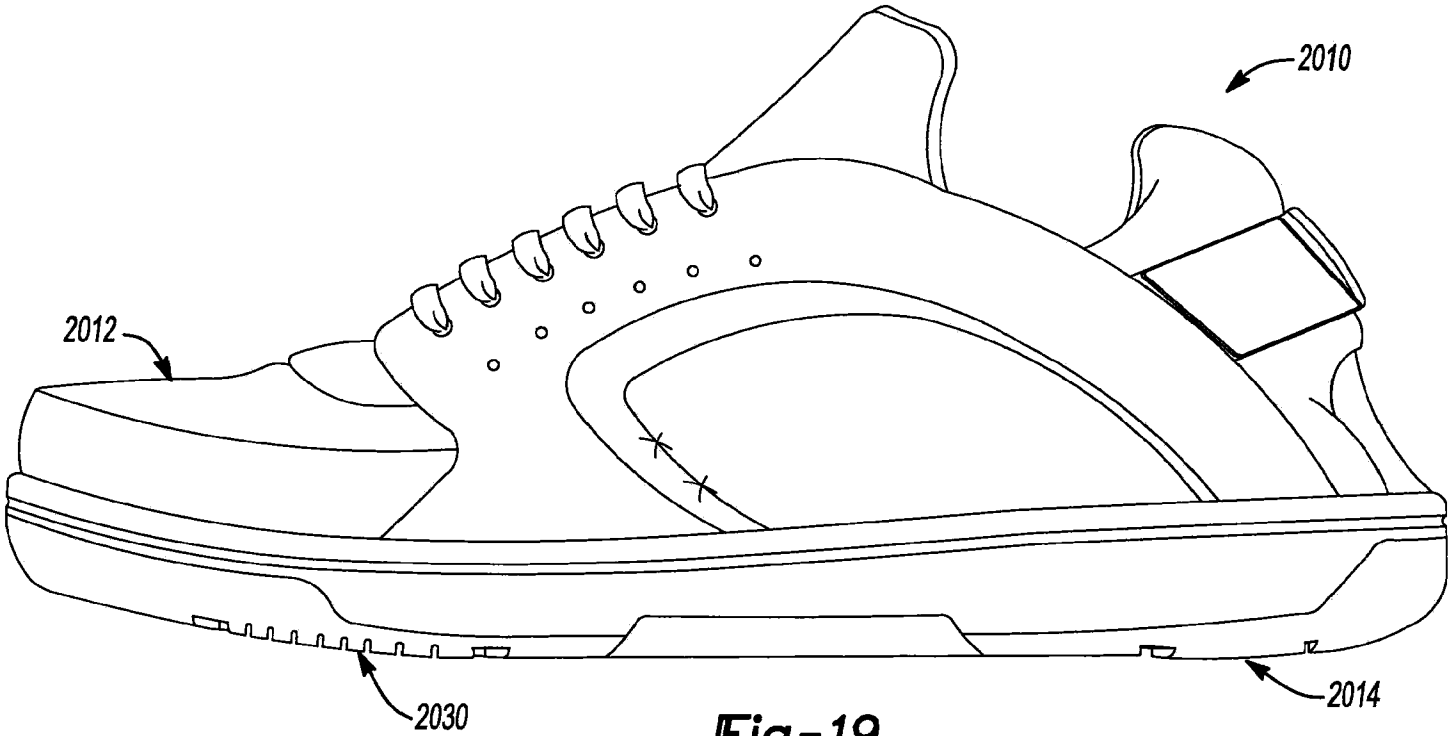
FIG. 19 is a side view of the outsole of FIG. 18.

With particular reference to FIG. 19, the sole structure 2014 is fastened to the upper structure 2012 via stitching, epoxy, and/or high frequency welding and includes an insole 2026 (FIG. 20), a midsole 2028, and an outsole 2030. The insole 2026, midsole 2028, and outsole 2030 cooperate to both absorb energy associated with the article of footwear 2010 contacting the ground during use, as well as to support the user's foot 2016 during movements associated with particular activities such as, for example, dancing and aerobics. In order to absorb the energy associated with the article of footwear 2010 contacting the ground, the sole structure 2014 may incorporate dense, cushioning materials. Materials with such properties reduce the amount of force transmitted to the user's foot 2016 as a result of the article of footwear 2010 contacting the ground and, as such, provide the user's foot 2016 with increased comfort and protection.

Figure 20:
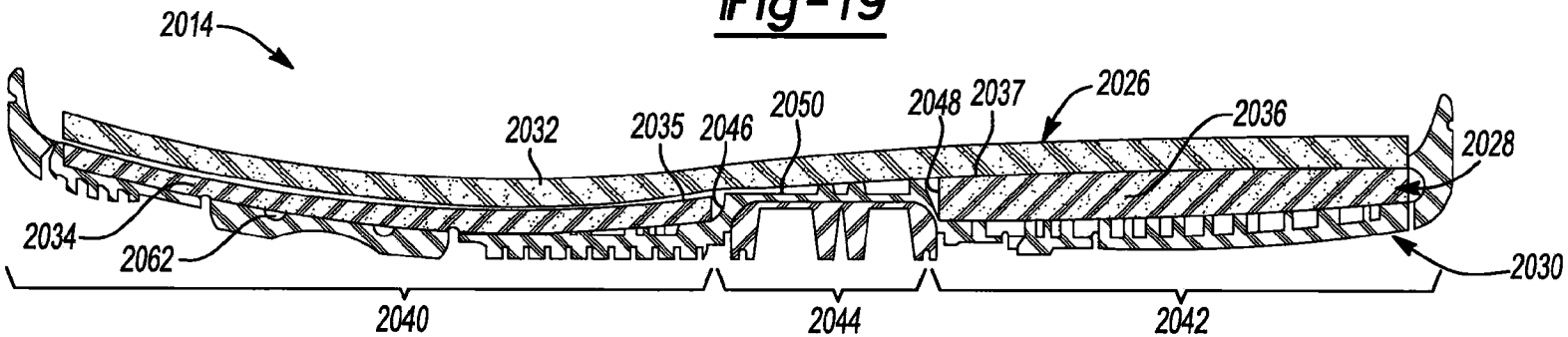
FIG. 20 is a cross-sectional view of the outsole taken along line 3-3 of FIG. 18.

With reference to FIG. 20, the insole 2026 includes a liner 2032 positioned within the article of footwear 2010 to contact and support a bottom portion of the user's foot 2016. The liner 2032 includes a shape that generally conforms to a shape of a bottom portion of the user's foot 2016 and may be manufactured from a material that absorbs and otherwise directs moisture away from the user's foot 2016. The liner 2032 may be secured to the material of the upper structure 2012 via adhesive to prevent removal of the liner 2032 from the article of footwear 2010. In one configuration, the liner 2032 is attached to a Strobel material of the upper structure 2012 via an adhesive. Alternatively, the liner 2032 may remain unsecured to allow removal and/or replacement of the liner 2032 for aesthetic or hygienic reasons. The liner 2032 is formed from a generally soft material, such as a woven polyester material, to both provide the user's foot 2016 with a degree of comfort and protection during use.

The midsole 2028 includes a forefoot insert 2034 and a heel insert 2036 respectively associated with the ball and the heel of the user's foot 2016. In one construction, the inserts 2034, 2036 may be molded from a foamed material, such as an ethylene vinyl acetate (EVA), to provide a lightweight and durable construction while concurrently providing the ball and heel of the user's foot 2016 with additional support and stability. Regardless of the particular material, the inserts 2034, 2036 cooperate with the liner 2032 and the outsole 2030 to absorb energy during use.

The outsole 2030 includes a forefoot portion 2040, a heel portion 2042, and a midfoot portion 2044 disposed generally between the forefoot portion 2040 and the heel portion 2042. The inserts 2034, 2036 of the midsole 2028 may be disposed in recesses 2046, 2048 formed in an upper surface 2050 of the outsole 2030 at the forefoot portion 2040 and the heel portion 2042, respectively. Positioning the inserts 2034, 2036 within the recesses 2046, 2048 reduces the overall height and weight of the sole structure 2014.

The recesses 2046, 2048 may be positioned in the outsole 2030 such that the midfoot portion 2044—disposed between the forefoot and heel portions 2040, 2042—remains in contact with the liner 2032. Specifically, each recess 2046, 2048 may include a depth substantially equal to a thickness of each insert 2034, 2036 such that a top surface 2035, 2037 of each insert 2034, 2036 is substantially flush with the upper surface 2050. Aligning the top surfaces 2035, 2037 of the respective inserts 2034, 2036 with the upper surface 2050 provides a constant surface on which the liner 2032 may be evenly supported.

The liner 2032 is generally surrounded by the upper structure 2012, while covering both of the inserts 2034, 2036 and the midfoot portion 2044 of the outsole 2030. If the upper structure 2012 includes a Strobel material (not shown), the Strobel material is disposed generally between the liner 2032 and the top surfaces 2035, 2036 of the inserts 2034, 2036 and the upper surface 2050 of the outsole 2030. The Strobel material may be attached to any of the liner 2032, inserts 2034, 2036, or upper surface 2050 of the outsole 2030 via an adhesive to maintain proper alignment between the liner 2032, Strobel material, inserts 2034, 2036, and outsole 2030.

In one construction, the outsole 2030 is molded of a foam material such as thermoplastic polyurethane (TPU). The TPU material assists in providing the article of footwear 2010 with a lightweight and durable construction while concurrently providing the user's foot 2016 with support and stability. In addition to providing the article of footwear 2010 with a degree of comfort, durability, and stability, the TPU material also provides the article of footwear 2010 with a stylish appearance, as the TPU material readily accepts various dyes and, as such, can be formed in virtually any color. Depending upon the particular requirements for the article of footwear 2010, however, the outsole 2030 may be molded from a variety of alternate materials, such as ethylene vinyl acetate (EVA), rubber, or injection pylon.

Figure 21:
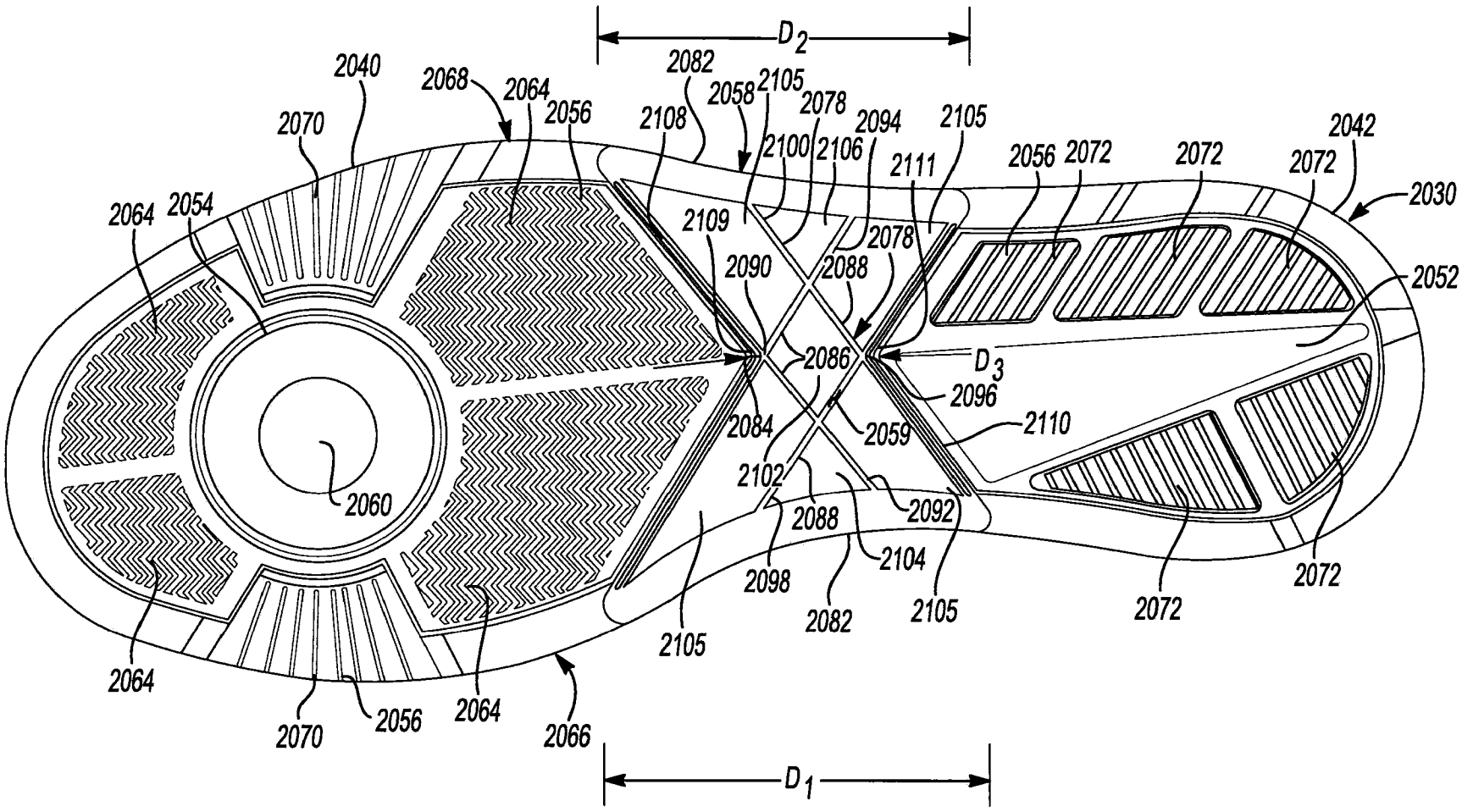
FIG. 21 is a bottom view of an outsole of the article of footwear of FIG. 18.

Referring now to FIG. 21, the outsole 2030 includes a pivot lug 2054, a plurality of flex grooves 2056, and an insert 2058. The pivot lug 2054 may extend or protrude farther from a bottom surface of the outsole 2030 than the surrounding structure. For example, the pivot lug 2054 may extend from a bottom surface of the outsole 2030 a greater distance than the adjacent structure forming the flex grooves 2056. Alternatively, the pivot lug 2054 may be substantially flush with the adjacent structure to provide the undersurface 2052 of the outsole 2030 located proximate to the forefoot position 2040 with a substantially constant surface. Regardless of the particular construction of the pivot lug 2054, the pivot lug 2054 provides the outsole 2030 and, thus, the article of footwear 2010, with a pivot point allowing a user to easily pivot and/or slide during use.

In one configuration, the pivot lug 2054 is positioned centrally on the forefoot portion 2040 and may extend outwardly from the undersurface 2052 of the outsole 2030 by a predetermined distance (e.g., five (5) mm). In other configurations, the pivot lug 2054 may be disposed peripherally on the forefoot portion 2040 or may be located elsewhere on the undersurface 2052 of the outsole 2030. The pivot lug 2054 may be configured in various geometric or irregular shapes including circular, rectangular, and elliptical. The pivot lug 2054 may also include features, such as a concavity 2060 and/or a ringed pocket 2062 (FIG. 20), that function together or independently to permit compression of the pivot lug 2054 when subjected to a predetermined force during use.

As shown in FIGS. 20 and 21, the ringed pocket 2062 may be formed on an opposite side of the pivot lug 2054 from the concavity 2060. The ringed pocket 2062 may include a greater diameter than that of the concavity 2060 such that the concavity 2060 is surrounded by the ringed pocket 2062. Regardless of the particular sizes of the concavity 2060 and ringed pocket 2062, the concavity 2060 and ringed pocket 2062 may be positioned relative to one another such that the concavity 2060 is substantially concentric with the ringed pocket 2062.

The plurality of flex grooves 2056 may provide traction and/or additional flexibility when the user's foot 2016 flexes or bends the sole structure 2014. Furthermore, the plurality of flex grooves 2056 may provide varying coefficients of friction in different positions on the outsole 2030. For example, forefoot flex grooves 2064 extending between a medial side 2066 and a lateral side 2068 of the outsole 2030 may be formed in a zigzag pattern to enhance the flexibility and traction of the forefoot portion 2040 in multiple directions. Peripheral flex grooves 2070 may extend radially around the pivot lug 2054 to allow the article of footwear 2010 to bend during pivoting maneuvers while heel flex grooves 2072 may extend on linear angles to provide lateral traction. Regardless of the particular location and configuration, the plurality of flex grooves 2056 may be formed in the outsole 2030 during molding.

Figure 22:
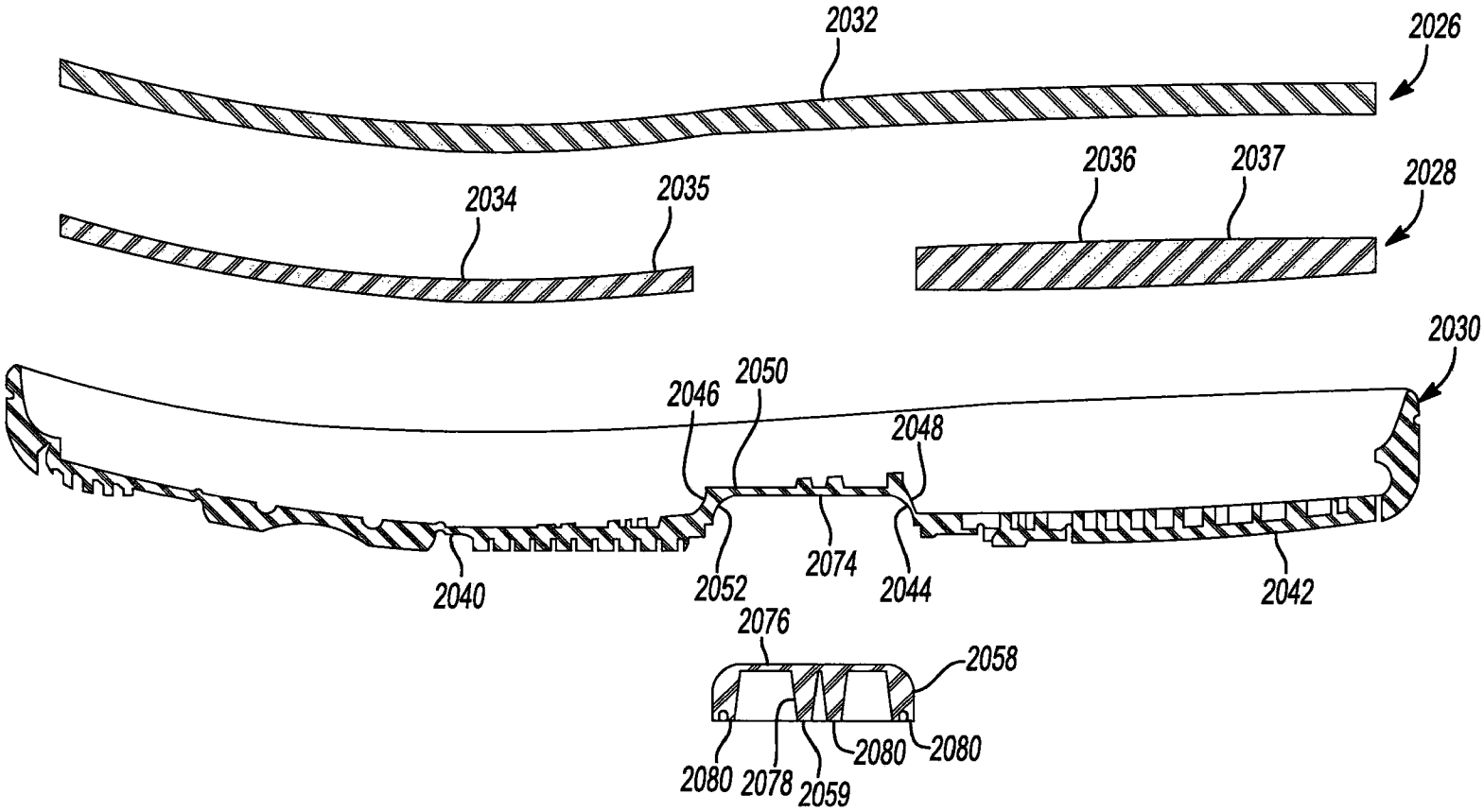
FIG. 22 is an exploded cross-sectional view of the outsole of FIG. 20.

As shown in FIGS. 20-22, the undersurface 2052 of the outsole 2030 includes a recess 2074 at the midfoot portion 2044 that receives the insert 2058. The insert 2058 may be fixedly secured to the midfoot portion 2044 at a base portion 2076 of the insert 2058 (FIG. 22) and is positioned such that the insert 2058 extends between the medial side 2066 and the lateral side 2068 of the outsole 2030. The recess 2074 includes a depth substantially equal to an overall height of the insert 2058 such that when the insert 2058 is received within the recess 2074, a bottom surface 2059 of the insert 2058 is substantially flush with the adjacent surfaces of the forefoot portion 2040 and heel portion 2042.

The insert 2058 includes a plurality of ribs 2078 extending from the base portion 2076 towards the bottom surface 2059 of the insert 2058. The plurality of ribs 2078 linearly extend from a periphery 2082 of the insert 2058 located at the medial and lateral sides 2066, 2068 towards a central portion 2084 located centrally on the midfoot portion 2044 of the article of footwear 2010. The central portion 2084 of the insert 2058 is disposed in proximity to or is aligned with a longitudinal axis of the outsole 2030 extending through an approximate center of the midfoot portion 2044. This configuration allows free ends 2080 of the plurality of ribs 2078 to flex when in contact with the ground and also provides concurrent flexibility and strength to the insert 2058.

The plurality of ribs 2078 includes a first pair of ribs 2086 formed in a substantially V-shaped configuration and a second pair of ribs 2088 formed in a substantially V-shaped configuration. The first pair of ribs 2086 have an apex 2090 disposed substantially at the central portion 2084 and directed towards the forefoot portion 2040. Ends 2092, 2094 of the ribs 2086 are respectively disposed at the medial and lateral sides 2066, 2068 of the midfoot portion 2044 such that the ends 2092, 2094 of the ribs 2086 terminate at the periphery 2082. The second pair of ribs 2088 have an apex 2096 disposed substantially at the central portion 2084 and directed towards the heel portion 2042. Ends 2098, 2100 of the ribs 2088 are respectively disposed at the medial and lateral sides 2066, 2068 such that the ends 2098, 2100 of the ribs 2088 terminate at the periphery 2082.

The apices 2090, 2096 are spaced a predetermined distance (e.g., twenty (20) mm) apart from each other such that the opposing first and second pairs of ribs 2086, 2088 cooperate to form a diamond-shaped pocket 2102 disposed centrally on the insert 2058. Likewise, the ribs 2086, 2088 cooperate proximate to ends 2092, 2098 and 2094, 2100 to form triangular pockets 2104, 2106 and substantially trapezoidal pockets 2105 at the medial and lateral sides 2066, 2068 of the insert 2058. While the plurality of ribs 2078 are described as being configured to form the diamond-shaped pocket 2102, triangular pockets 2104, 2106, and trapezoidal pockets 2105, the plurality of ribs 2078 may also form alternate polygonal shapes such as, for example, a rectangle, a pentagon, or a hexagon.

As shown in FIG. 21, the diamond-shaped pocket 2102 disposed proximate to the central portion 2084 includes a smaller volume than the total volume of pockets 2104, 2105, 2106 disposed proximate to the medial and lateral sides 2066, 2068 of the insert 2058 and a smaller volume than any one of the trapezoidal pockets 2105. The diamond-shaped pocket 2102 includes a smaller volume than the pockets 2105 or total volume of pockets 2104, 2105, 2106 disposed proximate to the medial and lateral sides 2066, 2068, as the ribs 2086, 2088 are disposed in closer proximity to one another near the longitudinal axis extending proximate to the central portion 2084 when compared to the ribs 2086, 2088 disposed proximate to the medial and lateral sides 2066, 2068. As will be described further below, providing the ribs 2086, 2088 in closer proximity to one another proximate to the longitudinal axis extending through the central portion 2084 of the insert 2058 provides the outsole 2030 with more rigidity at a center portion of the outsole 2030. As such, the outsole 2030 is permitted to flex to a greater extent proximate to the pockets 2104, 2105, 2106 when compared to an area of the outsole 2030 proximate to the diamond-shaped pocket 2102.

The plurality of ribs 2078 may also include third and fourth pairs of ribs 2108, 2110 for delimiting the insert 2058 at the forefoot and heel portions 2040, 2042, respectively. The third and fourth pairs of ribs 2108, 2110 are each configured in a substantially V-shape. The third pair of ribs 2108 share the apex 2090 with and substantially mirror the first pair of ribs 2086, while the fourth pair of ribs 2110 share the apex 2096 with and substantially mirror the second pair of ribs 2088. The third and fourth pairs of ribs 2108, 2110 are spaced apart by dimensions D1, D2 at the medial and lateral sides 2066, 2068 and by a dimension D3 at the central portion 2084. As the dimensions D1, D2 are greater than the dimension D3, the insert 2058 includes a substantially X-shape. The substantially X-shape of the insert 2058 allows the lateral side 2068 of the article of footwear 2010 to bend and twist about the central portion 2084 to a position different from that of the medial side 2066.

Positioning the apices 2090, 2096 in close proximity to one another at an approximate midpoint of the insert 2058 provides the central portion 2084 of the insert 2058 with increased rigidity when compared to the periphery 2082 of the insert 2058. Specifically, because the apices 2090, 2096 are spaced apart from one another by a dimension D3, which is less than D1 and D2 located at the periphery 2082 of the insert 2058, the proximity of the ribs 2086, 2088, 2108, 2110 in an area of the central portion 2084 provides the central portion 2084 with a higher concentration of ribs and, thus, rigidity when compared to the medial and lateral sides 2066, 2068.

Spacing the ribs 2086, 2088, 2108, 2110 a greater distance apart from one another at the periphery 2082 of the insert 2058 increases the flexibility of the insert 2058 at the periphery 2082. As such, spacing the ribs 2086, 2088, 2108, 2110 apart from one another at the periphery 2082 of the insert 2058 allows the insert 2058 to bend and flex more freely when compared to the central portion 2084 of the insert 2058, thereby allowing the insert 2058 to flex and rotate about a hypothetical axis extending between the apices 2090, 2096, 2109, 2111 of the ribs 2086, 2088, 2108, 2110. Allowing the insert 2058 to flex and rotate about such a hypothetical axis extending through the apices 2090, 2096, 2109, 2111 of the ribs 2086, 2088, 2108, 2110 likewise allows the outsole 2030 to flex and rotate about a longitudinal axis of the outsole 2030. Permitting such rotation about a longitudinal axis of the outsole 2030 allows a user to flex and pivot freely about a longitudinal axis of the article of footwear 2010 while concurrently providing support to the user's foot 2016 along the longitudinal axis of the outsole 2030 and insert 2058 at the apices 2090, 2096, 2109, 2111.

As described, the insert 2058 provides the outsole 2030 and, thus, the article of footwear 2010 with increased strength and resistance to torsion along a longitudinal axis of the article of footwear 2010 extending substantially through the apices 2090, 2096 while concurrently permitting the outsole 2030 to flex and rotate about such a longitudinal axis due to the spacing between the ribs 2086, 2088, 2108, 2110 disposed proximate to the periphery 2082 of the insert 2058. As such, the apices 2090, 2096 of the ribs 2086, 2088, in conjunction with apices 2109, 2111 of the ribs 2108, 2110, provide the insert 2058 with a "spine" that provides support for the insert 2058 and allows the outsole 2030 to flex and rotate about a longitudinal axis of the article of footwear 2010 extending substantially through the apices 2090, 2096, 2109, 2111.

The insert 2058 may be formed from ethylene vinyl acetate (EVA), rubber, or injection pylon. The insert 2058 may also be formed from the same material as used for the outsole 2030 for simplicity in manufacture and to provide the article of footwear 2010 with an outsole 2030 having a uniform construction. As such, the insert 2058 may be molded from a foam material or a thermoplastic polyurethane (TPU). As previously described, the TPU material readily accepts various dyes. As such, the insert 2058 may be formed in virtually any color. Accordingly, the insert 2058 may be formed in a contrasting color from the outsole 2030 or, alternatively, may include a similar or same color as the outsole 2030.

Because the insert 2058 may be formed in virtually any color, the insert 2058 may be a customizable feature of the article of footwear 2010. For example, a user, prior to purchasing the article of footwear 2010, may be able to select the particular color of the insert 2058 and/or forefoot portion 2040 and/or heel portion 2042 of the outsole 2030. As such, the forefoot portion 2040, heel portion 2042, and/or insert 2058 may be customizable to provide a user with the ability to select the particular color configuration for the outsole 2030. Furthermore, the user may be able to select the material of the insert 2058 to customize performance characteristics of the article of footwear 2010. For example, a user may select a more pliable material to increase the flexibility of the insert 2058 or, alternatively, may select a more rigid material to provide the insert 2058 and, thus, the outsole 2030, with a more rigid, less flexible construction.

Figure 23:
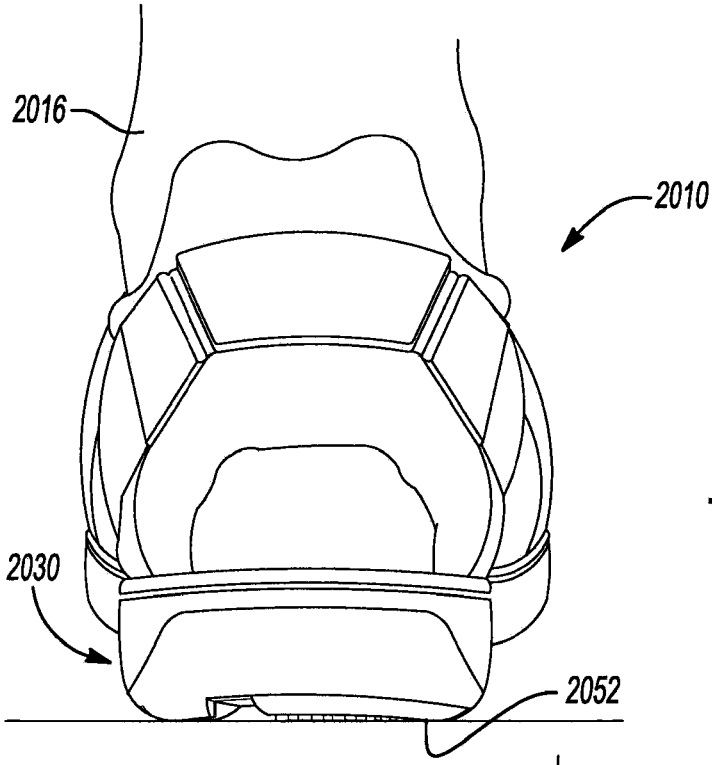
FIG. 23 is a rear view of the article of footwear of FIG. 18 in a substantially flat position with respect to ground.
Figure 24:
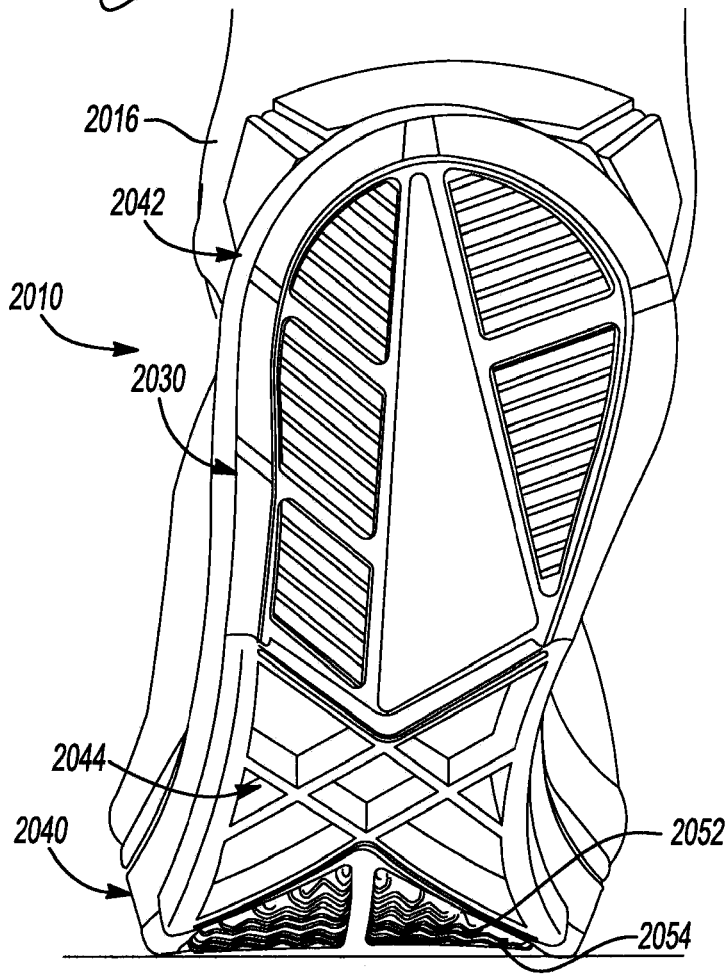
FIG. 24 is a rear view of the article of footwear of FIG. 18 in a pivoted position with respect to the ground.
Figure 25:
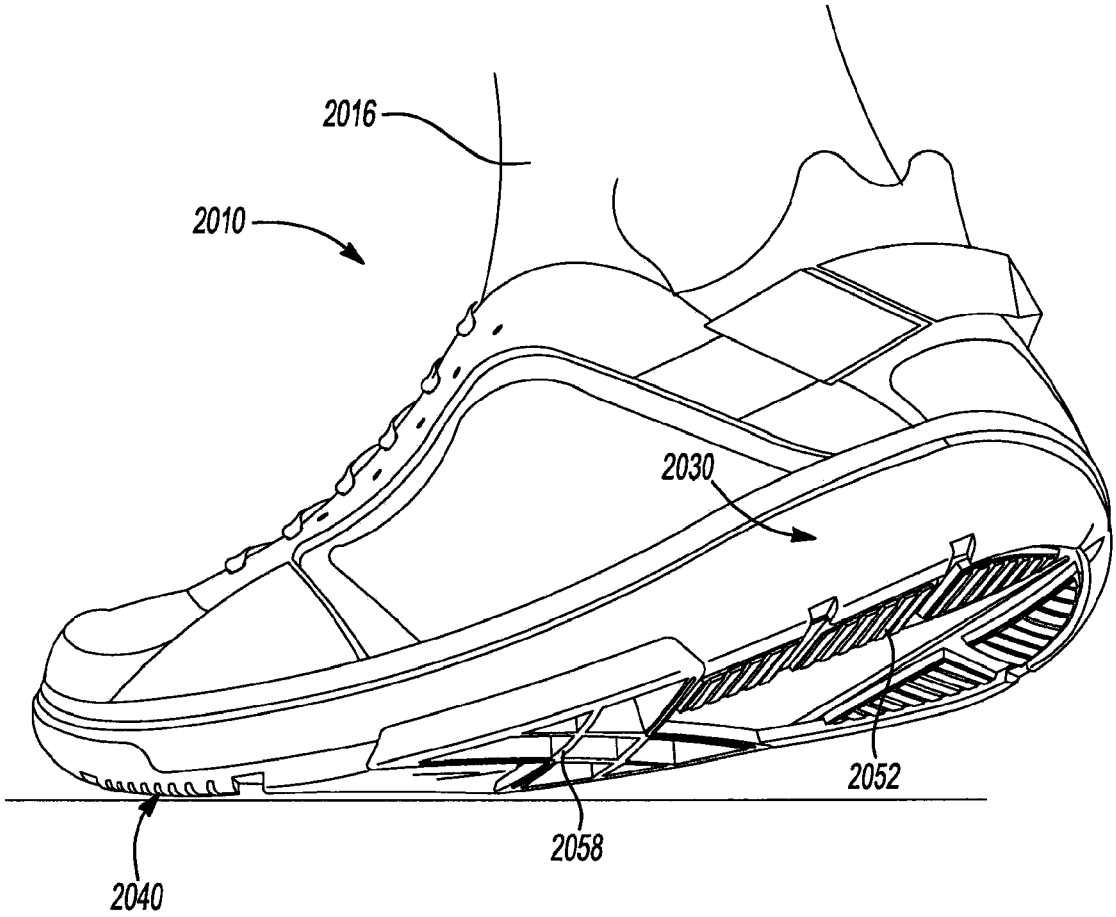
FIG. 25 is a perspective view of the article of footwear of FIG. 18 in a rotated position with respect to a longitudinal axis of the article of footwear.

With reference now to FIGS. 23-25, the article of footwear 2010 is shown in various use positions. As shown in FIG. 23, the undersurface 2052 of the outsole 2030 is predominantly flush with the ground when stationary. As the user's foot 2016 rises from the ground into a pivoted position (FIG. 24), the heel and midfoot portions 2042, 2044 of the article of footwear 2010 also raise accordingly. Balancing the user's foot 2016 on the forefoot portion 2040—in particular on the pivot lug 2054—causes the article of footwear 2010 to bend substantially through the forefoot and midfoot portions 2040, 2044. The forefoot and peripheral flex grooves 2064, 2070, along with the plurality of ribs 2078 of the insert 2058, separate to allow the article of footwear 2010 to stretch along the undersurface 2052 of the outsole 2030, while the upper surface 2050 of the outsole 2030 continues to conform to the user's foot 2016. In this way, the outsole 2030 can easily flex along with the user's foot 2016. The geometry of the insert 2058 (e.g. the diamond-shaped pocket 2102), however, prevents the midfoot portion 2044 from hyper-extending as the dimension D3 between the apices 2090, 2096 provides strength to the insert 2058.

The user's foot 2016 may also rotate to the side during sliding maneuvers and the like (FIG. 25). During these maneuvers, the user's foot 2016 may again balance on the forefoot portion 2040, and more particularly, on a portion of the peripheral flex grooves 2070. The forefoot flex grooves 2064 and the plurality of ribs 2078 of the insert 2058 separate to allow the article of footwear 2010 to stretch along the undersurface 2052 of the outsole 2030. However, in this state, the plurality of ribs 2078 of the insert 2058 act as a spine for the article of footwear 2010 and provide for controlled torsional flex about a longitudinal axis of the article of footwear 2010. Similar to the forward pivot 2054, in the side rotation, the plurality of ribs 2078 of the insert 2058 flex to allow the article of footwear 2010 to stretch along the undersurface 2052 of the outsole 2030, while the upper surface 2050 of the outsole 2030 continues to conform to the user's foot 2016. While the article of footwear 2010 is shown bending in the medial direction, it should be understood that the insert 2058 behaves similarly when bending in the lateral direction.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

What is claimed is:

1. An article of footwear comprising:

an outsole structure including a forefoot portion, a heel portion, and a midfoot portion disposed between said forefoot portion and said heel portion, said midfoot portion including a body with a base portion, the body defining a periphery, the periphery including a medial edge and a lateral edge, the body also including a first rib and a second rib that project from the base portion, the first rib and the second rib each extending longitudinally between the medial edge and the lateral edge, the first rib, the second rib, and the base portion, cooperating to define a ribless first pocket proximate to a longitudinal axis of the outsole structure, the first rib, the second rib, and the base portion, also cooperating to define a ribless peripheral pocket proximate to one of the medial and lateral edges, the first pocket having a smaller volume than the peripheral pocket.

2. The article of footwear of claim 1, wherein said midfoot portion includes a recess, wherein the body is an insert that is received within the recess.

3. The article of footwear of claim 1, wherein said first rib and said second rib are arranged in a substantially X-shape.

4. The article of footwear of claim 1, wherein said first and second ribs are spaced apart and separated from one another a greater distance adjacent the one of the medial and lateral edges, than at said longitudinal axis of said outsole structure.

5. The article of footwear of claim 1, wherein the body is formed from one of an ethylene vinyl acetate, a rubber, a thermoplastic polyurethane, and an injection pylon.

6. The article of footwear of claim 1, wherein said body is formed from a different color than at least one of said forefoot portion and said heel portion.

7. The article of footwear of claim 1, wherein said first pocket has a diamond shape.

8. The article of footwear of claim 1, wherein said first rib is substantially V-shaped, said first rib having distal ends respectively disposed proximate to said medial edge and said lateral edge, said first rib also having a first apex disposed proximate to said longitudinal axis.

9. The article of footwear of claim 8, wherein said second rib is substantially V-shaped rib, said second rib having distal ends respectively disposed proximate to said medial edge and said lateral edge, said second rib also having a second apex disposed proximate to said longitudinal axis.

10. The article of footwear of claim 9, wherein said first rib and said second rib are inverted with respect to each other.

11. A sole structure for an article of footwear, the sole structure comprising:

a forefoot portion;

a heel portion;

a midfoot portion disposed between said forefoot portion and said heel portion, the midfoot portion including a recess; and an insert that is received within the recess, the insert including a first rib having a pair of first ends respectively disposed proximate to medial and lateral outboard edges of said insert and a second rib having a pair of second ends respectively disposed proximate to medial and lateral outboard edges of said insert, said first rib cooperating with said second rib to define a first pocket disposed proximate to a center portion of the sole structure and a pair of second pockets disposed proximate to said medial and lateral outboard edges, respectively, said first pocket including a smaller volume than each of said second pockets.

12. The sole structure of claim 11, wherein said first rib and said second rib are arranged on the insert in a substantially X-shape.

13. The sole structure of claim 11, wherein said first rib is spaced apart and separated from said second rib a greater distance at said medial outboard edge and said lateral outboard edge than at said center portion of said sole structure.

14. The sole structure of claim 11, wherein said insert is formed from one of an ethylene vinyl acetate, a rubber, a thermoplastic polyurethane, and an injection pylon.

15. The sole structure of claim 11, wherein said insert is formed from a different color than at least one of said forefoot portion and said heel portion.

16. The sole structure of claim 11, wherein said first pocket includes a substantially diamond shape.

17. The sole structure of claim 11, wherein said first rib is a substantially V-shaped rib having the pair of first ends respectively disposed proximate to said medial outboard edge and said lateral outboard edge and a first apex disposed proximate to a longitudinal axis of the sole structure.

18. The sole structure of claim 17, wherein said second rib is a substantially V-shaped rib having the pair of second ends respectively disposed proximate to said medial outboard edge and said lateral outboard edge and a second apex disposed proximate to said longitudinal axis.

19. The sole structure of claim 18, wherein said second apex of said second rib extends in an opposite direction than said first apex of said first rib.

20. The article of footwear of claim 1, wherein the periphery is defined by a medial wall and a lateral wall that project from the base portion, the medial wall defining the medial edge and the lateral wall defining the lateral edge, wherein the first rib has first distal ends respectively connected to the medial wall and the lateral wall, and wherein the second rib has second distal ends respectively connected to the medial wall and the lateral wall.

21. The article of footwear of claim 1, wherein the peripheral pocket is a medial peripheral pocket that is proximate to the medial edge, the first rib, the second rib, and the base portion also cooperating to define a lateral peripheral pocket that is proximate to the lateral edge, the first pocket having a smaller volume that both the medial and lateral peripheral pockets.

22. The article of footwear of claim 1, wherein the body also includes a third rib that projects from the base portion and that extends longitudinally between the medial edge and the lateral edge, the first rib, the third rib and the base portion cooperating to define at least one ribless third pocket that is proximate to one of the medial and lateral edges, the first pocket having a smaller volume than the at least one ribless third pocket.

23. The article of footwear of claim 22, wherein the third rib is substantially V-shaped and inverted relative to the first rib.

* * * * *